US005596390A

United States Patent [19]

Sawada

[11] Patent Number: 5,596,390

[45] Date of Patent: Jan. 21, 1997

[54] IMAGE FORMING APPARATUS AND SYSTEM FOR ADMINISTERING THE SAME

[75] Inventor: Masaithi Sawada, Tokyo, Japan

[73] Assignee: Ricoh Company, Ltd., Tokyo, Japan

[21] Appl. No.: 533,758

[22] Filed: Sep. 26, 1995

[30] Foreign Application Priority Data

Sep. 26, 1994 [JP] Japan ..... 6-229459
Apr. 14, 1995 [JP] Japan ..... 7-089688

[51] Int. Cl.[6] ..... G03G 15/00

[52] U.S. Cl. ..... 399/8; 377/16; 395/184.01; 399/10

[58] Field of Search ..... 355/200, 202, 355/204, 206, 208; 371/16; 395/184.01

[56] References Cited

U.S. PATENT DOCUMENTS 5,023,817 6/1991 Au et al. ..... 377/16 X
5,223,896 6/1993 Shimizu et al. ..... 355/208
5,359,391 10/1994 Kuroyanagi et al. ..... 355/204

FOREIGN PATENT DOCUMENTS 60-263163 12/1985 Japan .
3-64245 3/1991 Japan .
3-64770 3/1991 Japan .
3-162055 7/1991 Japan .
3-196053 8/1991 Japan .
3-252671 11/1991 Japan .
3-293369 12/1991 Japan .
4-367871 12/1992 Japan .

*Primary Examiner*—Joan H. Pendegrass
*Attorney, Agent, or Firm*—Oblon, Spivak, McClelland, Maier & Neustadt, P.C.

[57] ABSTRACT

In a system for collectively controlling a plurality of image forming apparatuses connected to a control station by a communication line, each apparatus counts the occurrences that any one of the outputs of sensors exceeds a particular second limit value before reaching a first limit value representative of the operation limit of the apparatus, stores the date of counting or similar time information or the cumulative number of copies at the time of counting, and sends the count and the time information or the cumulative number of copies to the control station. The system is capable of estimating troubles to occur in the individual apparatuses by low-cost simple statistical processing.

42 Claims, 22 Drawing Sheets

IMAGE FORMING APPARATUS AND SYSTEM FOR ADMINISTERING THE SAME

BACKGROUND OF THE INVENTION

The present invention relates to a system for collectively administering a plurality of copiers, printers or similar image forming apparatuses connected to a control station by a communication line.

A trouble estimating device is conventional which estimates a trouble to occur in an image forming apparatus by monitoring signals output from the apparatus. For example, Japanese Patent Laid-Open Publication No. 58-221409 teaches a device of the type measuring time intervals at which sensors monitoring the operating conditions of the apparatus output signals, producing statistics, including mean values, deviations and variations, on the basis of the intervals, storing them in a memory, comparing the stored statistics with corresponding limit values stored in the memory beforehand, and displaying an estimated trouble when any one of the statistics exceeds the associated limit value.

In practice, however, an image forming apparatus generates a number of signals during the course of image formation. Hence, the conventional trouble estimating device described above needs a memory having a capacity great enough to accommodate all the statistics derived from the different kinds of time intervals and all the limit values corresponding thereto. Moreover, the procedure for producing the statistics is complicated. When the device is mounted on an image forming apparatus, it produces the individual statistics for every image forming cycle of the apparatus. This complicates the control over the apparatus and is apt to adversely effect the image forming operation.

SUMMARY OF THE INVENTION

It is, therefore, an object of the present invention to provide an image forming apparatus and a system for administering it which are capable of estimating troubles to occur in the apparatus by low-cost simple statistical processing.

In accordance with the present invention, an image forming apparatus has a second limit value setting setter for setting second limit values which the outputs of sensors disposed in the apparatus respectively reach before reaching the respective first limit values each being representative of the operation limit of the apparatus. Counters respectively count the occurrences that the outputs of the sensors exceed the respective second limit values. Time information memories are respectively associated with the counters, and respectively store dates or similar time information representative of the times when the counters counted the occurrences. A transmitter tansmits the counts of the counters and the time information stored in the time information memories.

Also, in accordance with the present invention, an image forming apparatus has a second limit value setter for setting second limit values which the outputs of sensors disposed in the apparatus respectively reach before reaching the respective first limit values each being representative of the operation limit of the apparatus. Counters respectively count the occurrences that the outputs of the sensors exceed the respective second limit values. Cumulative copy number memories are respectively associated with the counters, and respectively store the cumulative numbers of copies at the time when the counters counted the occurrences. A transmitter transmits the counts of the counters and the cumulative numbers of copies stored in the cumulative copy number memories.

Further, in accordance with the present invention, an image forming apparatus has a second limit value setter for setting second limit values which the outputs of sensors disposed in the apparatus respectively reach before reaching the respective first limit values each being representative of the operation limit of said apparatus. Counters respectively count the occurrences that the outputs of the sensors exceeds the respective second limit values. Time information memories are respectively associated with the counters, and respectively store dates or similar time information representative of the times when the counters counted the occurrences. A trouble estimator estimates a trouble to occur in the apparatus on the basis of the counts of the counters and the time information stored in the time information memories.

Further, in accordance with the present invention, an image forming apparatus has a second limit value setter for setting second limit values which the outputs of sensors disposed in the apparatus respectively reach before reaching the respective first limit values each being representative of an operation limit of said apparatus. Counters respectively count the occurrences that the outputs of the sensors exceed the respective second limit values. Cumulative copy number memories are respectively associated with the cumulative copy number memories, and respectively store cumulative numbers of copies at the time when the counters counted the occurrences. A trouble estimator estimates a trouble to occur in the apparatus on the basis of the counts of the counters and the cumulative numbers stored in the cumulative copy number memories.

Further, in accordance with the present invention, a system for administering a plurality of image forming apparatuses is provided. The image forming apparatuses each has a second limit value setter for setting second limit values which the outputs of sensors disposed in the apparatus respectively reach before reaching respective first limit values each being representative of the operation limit of the apparatus, counters for respectively counting the occurrences that the outputs of the sensors exceed the respective second limit values, time information memories respectively associated with the counters, and for respectively storing dates or similar time information representative of the times when the counters counted the occurrences, and a transmitter for transmitting the counts of the counters and the time information stored in the time information memories. The system has a control device for collectively controlling the image forming apparatuses, and a communication line for connecting the image forming apparatuses to the control device. The transmitter transmits the counts of the counters and the time information stored in the time information memories. The control device estimates a trouble to occur in the image forming apparatuses on the basis of the counts and time information.

Further, in accordance with the present invention, a system for administering a plurality of image forming apparatuses is provided. The image forming apparatuses each has a second limit value setter for setting second limit values which the outputs of sensors disposed in the apparatus respectively reach before reaching the respective first limit values each being representative of the operation limit of the apparatus, counters for respectively counting the occurrences that the outputs of the sensors exceed the respective second limit values, cumulative copy number memories respectively associated with the counters, and for respectively storing the cumulative numbers of copies at the time when the counters counted the occurrences, and a transmitter for transmitting the counts of the counters and the cumulative numbers of copies stored in the cumulative copy number memories. The system has a control device for collectively controlling the image forming apparatuses, and a communication line for connecting the image forming apparatuses to the control device. The transmitter transmits the counts of thef counters and the cumulative numbers of copies stored in the cumulative copy number memories. The control device estimates a trouble to occur in the image forming apparatuses on the basis of the counts and cumulative numbers of copies.

Further, in accordance with the present invention, an image forming method has the steps of setting second limit values which the outputs of sensors disposed in the apparatus respectively reach before reaching the respective first limit values each being representative of the operation limit of the apparatus, counting the occurrences that any one of the outputs of the sensors exceeds the respective second limit value, storing a date or similar time information representative of the time when the occurrences were counted, and transmitting the count of the occurrences and time information.

Further, in accordance with the present invention, an image forming method has the steps of setting second limit values which the outputs of sensors disposed in the apparatus respectively reach before reaching the respective first limit values each being representative of the operation limit of the apparatus, counting the occurrences that any one of the outputs of the sensors exceeds the respective second limit value, storing the cumulative number of copies at the time when the occurrences were counted, and transmitting the count of the occurrences and cumulative number of copies.

Further, in accordance with the present invention, an image forming method has the steps of setting second limit values which the outputs of sensors disposed in the apparatus respectively reach before reaching the respective first limit values each being representative of the operation limit of the apparatus, counting the occurrences that any one of the outputs of the sensors exceeds the respective second limit value, storing a date or similar time information representative of the time when the occurrences were counted, and estimating a trouble to occur in the apparatus on the basis of the count of the occurrences and time information.

Furthermore, in accordance with the present invention, an image forming method has the steps of setting second limit values which the outputs of sensors disposed in the apparatus respectively reach before reaching the respective first limit values each being representative of the operation limit of the apparatus, counting the occurrences that any one of the outputs of the sensors exceeds the respective second limit value, storing the cumulative number of copies at the time when the occurrences were counted, and estimating a trouble to occur in the apparatus on the basis of the count of the occurrences and cumulative number of copies.

Moreover, in accordance with the present invention, a method of collectively administering a plurality of image forming apparatuses connected to a control device by a communication line is provided. The method has the steps of preparing the image forming apparatuses each having a second limit value setter for setting second limit values which the outputs of sensors disposed in the apparatus respectively reach before reaching the respective first limit values each being representative of the operation limit of the apparatus, counters for respectively counting the occurrences that the outputs of the sensors exceeds the respective second limit values, time information memories respectively associated with the counters and for respectively storing dates or similar time information representative of the times when the counters counted the occurrences, and a transmitter for transmitting the counts of the counters and the time information stored in the time information memoriese; causing the transmitter to send the counts of the counters and the time information stored in the time information memories; and causing the control device to estimate trouble to occur in the image forming apparatuss on the basis of the counts and time information.

In addition, in accordance with the present invention, a method of collectively administering a plurality of image forming apparatuses connected to a control device by a communication line is provided. The method has the steps of preparing the image forming apparatuses each having a second limit value setter for setting second limit values which the outputs of sensors disposed in the apparatus respectively reach before reaching the respective first limit values each being representative of the operation limit of the apparatus, counters for respectively counting the occurrences that the outputs of the sensors exceed the respective second limit values, cumulative copy number memories respectively associated with the counters and for storing the cumulative numbers of copies at the time when the respective counters counted the occurrences, and a transmitter for transmitting the counts of the counters and the cumulative numbers of copies stored in the cumulative copy number memories; causing the transmitter to send the counts of the counters and the cumulative numbers of copies stored in the cumulative copy number memories; and causing the control device to estimate troubles to occur in the image forming apparatuses on the basis of the counts and cumulative numbers of copies.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
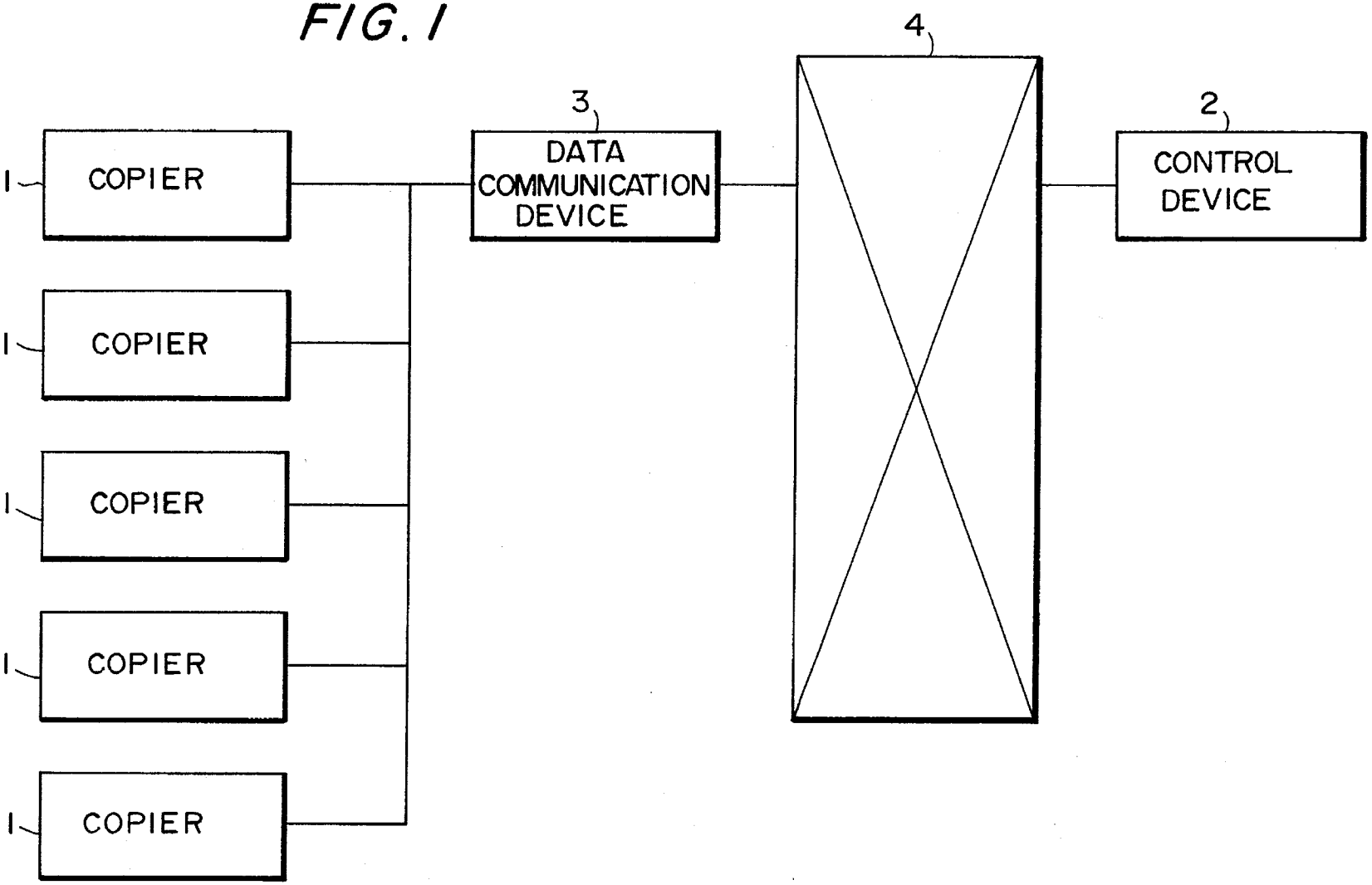
FIG. 1 is a block diagram schematically showing a system for controlling image forming apparatuses and embodying the present invention.

Referring to FIG. 1 of the drawings, a system for administering image forming apparatus and embodying the present invention is shown. As shown, the system includes five copiers 1 based on telediagnosis, and a control device or station 2. The copiers 1 and control station 2 are connected together by a data communication device 3 and a communication line 4. The control station 2 is capable of collectively controlling the copiers 1.

The data communication device 3 transfers a text to any one of the copiers 1 in response to a request from the control station 2 or transfers a text to the station 2 over the communication line 4 in response to a request from the copier 1. The device 3 is continuously powered throughout the day and capable of communicating with the control station 2 even at night when the copiers 1 are usually switched off. The device 3 is connected to the copiers 1 by a communication interface RS-485 in a multidrop configuration and communicates with them by polling and selection.

Figure 2:
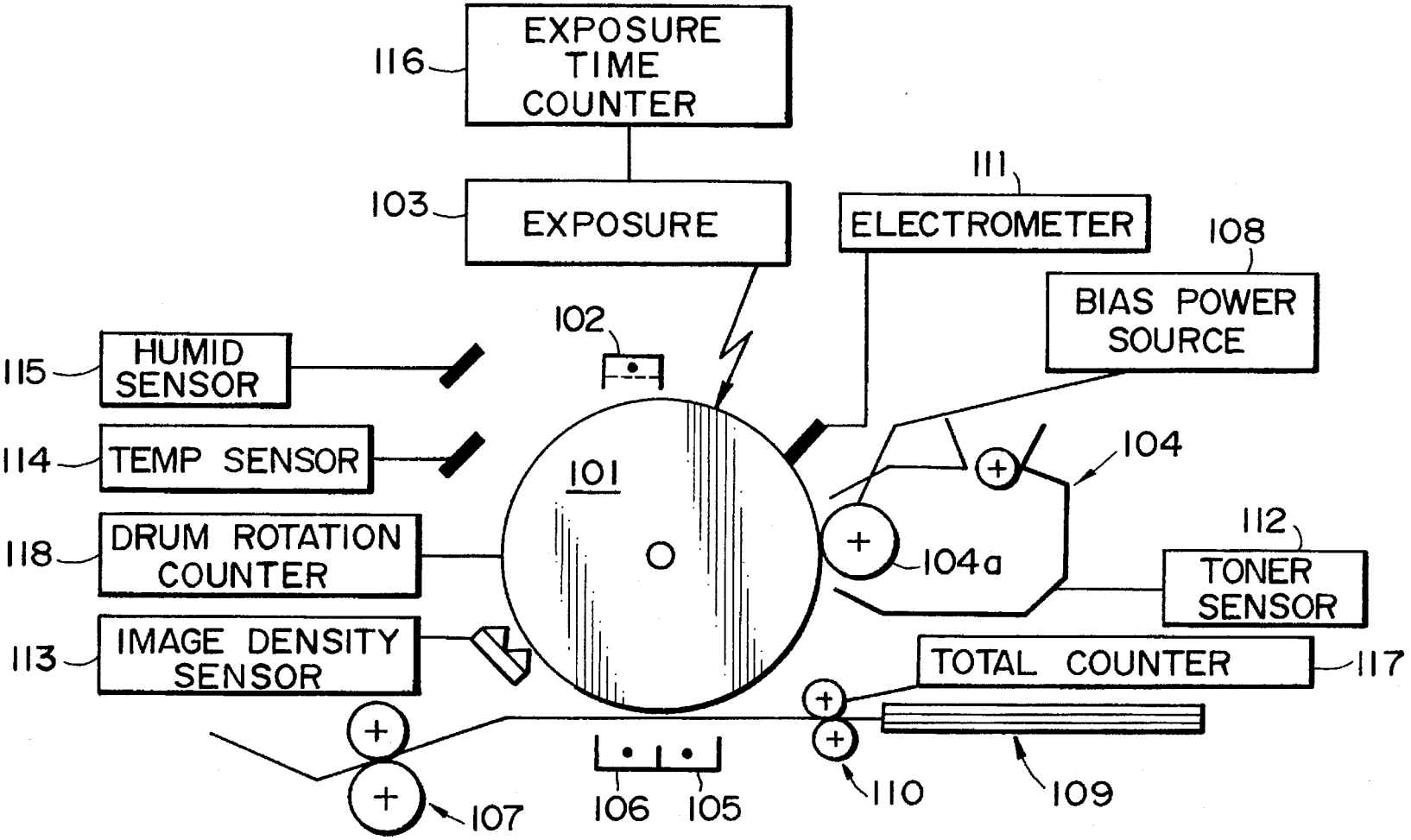
FIG. 2 shows a specific configuration of a part of a copier which is a specific form of the image forming apparatus.

FIG. 2 shows a photoconductive drum included in each copier 1, and various units surrounding it. As shown, the copier 1 has a photoconductive drum 101 formed of an organic photoconductor (OPC). Arranged around the drum 101 are a charger 102, an exposing section 103, a developing section 104, an image transferring section 105, a paper separating section 106, a fixing section 107, and other conventional sections for implementing an image forming process. While the drum 101 is rotated by a motor, not shown, the exposing section 103 exposes it imagewise with light representative of a document image and thereby electrostatically forms a latent image. The developing unit 104 includes a developing roller **104*a* to which a preselected bias for development is applied from a bias power source 108. The developing roller 104*a* develops the latent image with toner for thereby producing a corresponding toner image. The image transferring section 105 transfers the toner image from the drum 101 to a paper fed from a paper feed section 109 via a registration roller pair 110. Subsequently, the paper is separated from the drum 101 by the separating section 106 and conveyed to the fixing section 107. The fixing section 107 fixes the toner image on the paper by applying heat thereto. Then, the paper is driven out to a copy tray. The toner remaining on the drum 101** after the image transfer is removed by a cleaning section, not shown.

The copier 1 further includes an electrometer 111, a toner concentration sensor 112, an image density sensor 113, a temperature sensor 114, a humidity sensor 115 and other sensors joining in image control, and various counters including an exposure time counter 116, a total counter 117, and a drum rotation counter 118. The electrometer 111 is responsive to the surface potential of the drum 101, i.e., the charge potential deposited by the charger 102 and the potential of the portion illuminated by the exposing section 103. The toner concentration sensor 112 senses the concentration of toner existing in the developing section 104. The image density sensor 113 senses the density of a toner image left on the drum 101. The temperature sensor 114 and humidity sensor 115 are respectively responsive to temperature and humidity around the drum 101. The exposure time counter 116 counts the duration of exposure effected by the exposing section 103. The total counter 117 counts copies produced in synchronism with the rotation of the registration roller pair 110. The drum rotation counter 118 counts the rotations of the drum 101.

Figure 3:
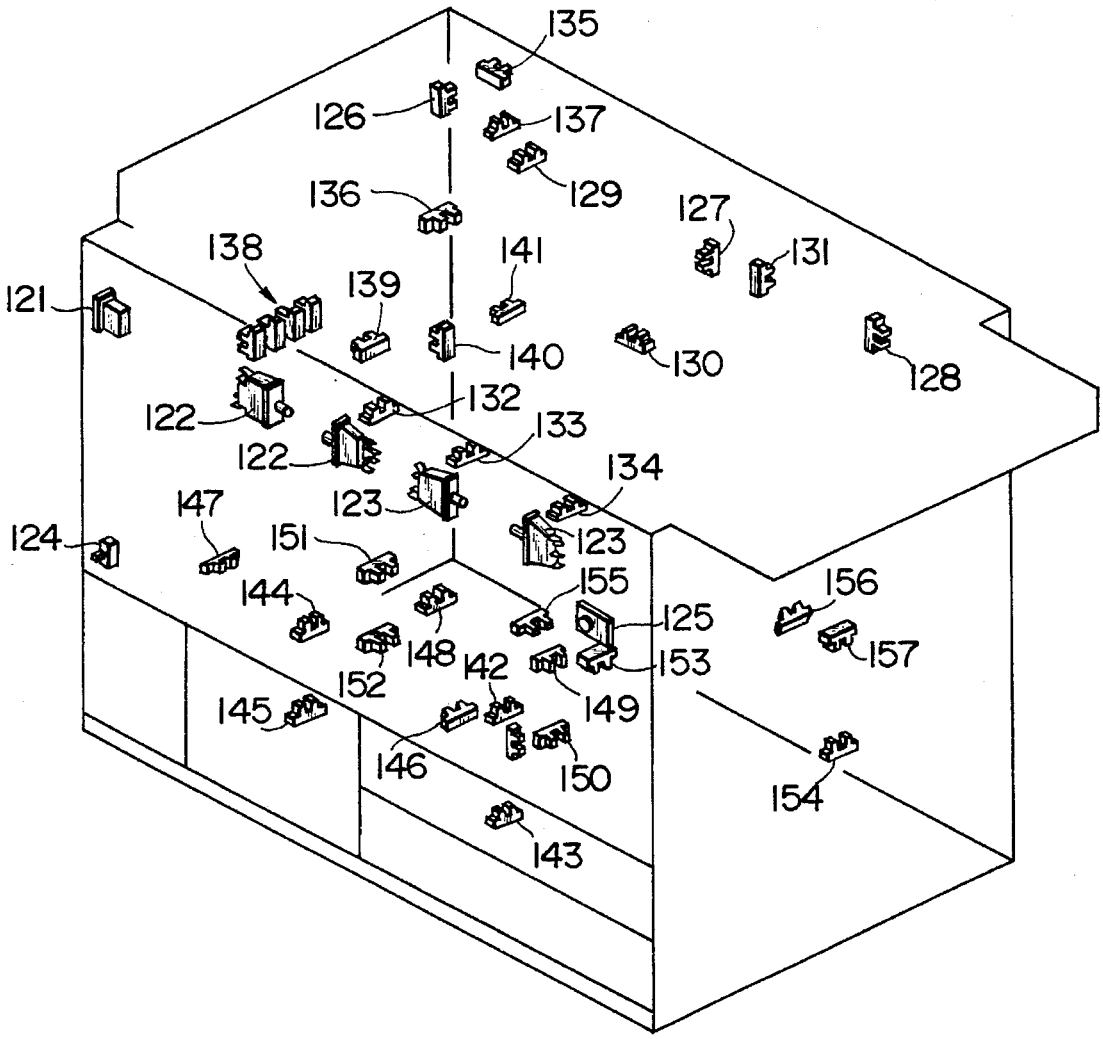
FIG. 3 is a perspective view showing a specific arrangement of sensors and switches joining in the self-diagnosis of the copier.

FIG. 3 shows examples of sensors and switches relating to the self-diagnosis of the copier 1. As shown, the copier 1 has a main switch 121, a left door switch 122, a right door switch 123, a dry switch 124, an error reset switch 125, a scanner encoder 126, a lens thrust encoder 127, a lens axis encoder 128. The copier 1 also has a scanner home sensor 129, a lens thrust home sensor 130, a lens axis home sensor 131, a return home sensor 132, a sheet through home sensor 133, a scanner home sensor 134, a collection coil load sensor 135, a toner near-end sensor 136, a toner cartridge sensor 137, a manual feed size sensor 138, a manual feed paper end sensor 139, a manual feed sensor 140, and a manual feed paper sensor 141. Further, the copier 1 has a first paper feed sensor 142, a second paper feed sensor 143, a third paper feed sensor 144, a fourth paper feed sensor 145, a pick-up position sensor 146, a registration sensor 147, a horizontal sensor 148, a first upper limit sensor 149, a second upper limit sensor 150, a third upper limit sensor 151, a fourth upper limit sensor 152, a duplex paper end sensor 153, a duplex inlet sensor 154, a duplex paper feed sensor 155, a fixation sensor 156, and a paper discharge sensor 157.

Figure 4:
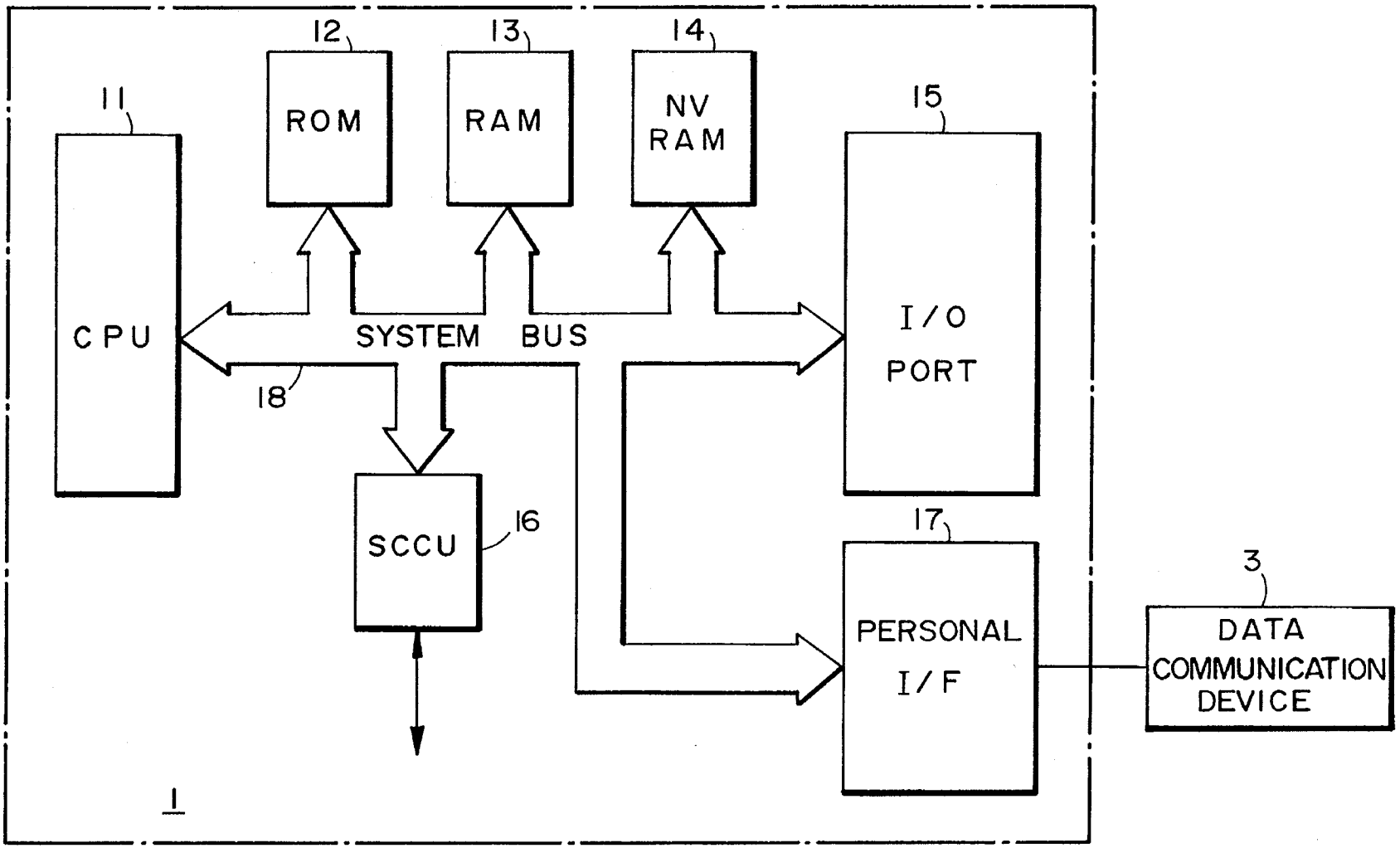
FIG. 4 is a block diagram schematically showing a specific construction of a control section included in the copier.

FIG. 4 shows control circuitry incorporated in the copier 1. As shown, the circuitry has PPC controller made up of a CPU (Central Processing Unit) 11, a ROM (Read Only Memory) 12, a RAM (Random Access Memory) 13, a nonvolatile RAM (NVRAM) 14, an I/O (Input/Output) port 15, and a serial communication control unit (SCCU) 16, a personal interface (I/F) 17, and a system bus 18.

The CPU 11 controls the entire control circuitry in accordance with a control program stored in the ROM 12. The ROM 12 stores various kinds of fixed data including the control program. The RAM 13 plays the role of, e.g., a work memory to be used by the CPU 11. The NVRAM 14 serves as a memory for storing, e.g., the contents of mode commands input from an operation panel or the like, which will be described, or counters implementing the exposure time counter 116, total counter 117, drum rotation counter 118, etc.

Connected to the I/O port 15 are a high-tension power source for applying a particular high voltage to each of the charger 102, image transferring section 105, and separating section 106, an optics control section for controlling the optics of the exposing section or scanner 103, the bias power source 108 for applying a bias to the developing roller 104*a*, a heater control section for controlling the heater of the fixing section 107, motors, solenoids, clutches and other sequence devices, and sensors and switches including the electrometer 111 and sensors 112, 113, 114 and 115. While only one SCCU 16 is shown in FIG. 4, in practice a plurality of SCCUs are included in the control circuitry. The SCCU 16 interchanges signals with an operation panel and an automatic document feeder, not shown.

The personal I/F 17 supervises the communication between the data communication device 3 and the copier 1 and serves to reduce the load on the CPU 11. In principle, the I/F 17 does not perform any decision or processing as to the contents of data interchanged between the copier 1 and the control station 2, but it executes only the following processing relating to the protocol:

(1) monitoring polling and selecting messages (2) acknowledgement and negation processing (3) parity check (4) resend request processing during communication between the data communication device 3 and the copier 1

(5) text header processing (6) checking the properness of received processing codes The system bus 18 is made up of an address bus, control bus, and data bus and connects the CPU 11, ROM 12, RAM 13, NVRAM 14, I/O port 15, SCCU 16, and personal I/F 17.

Figure 5:
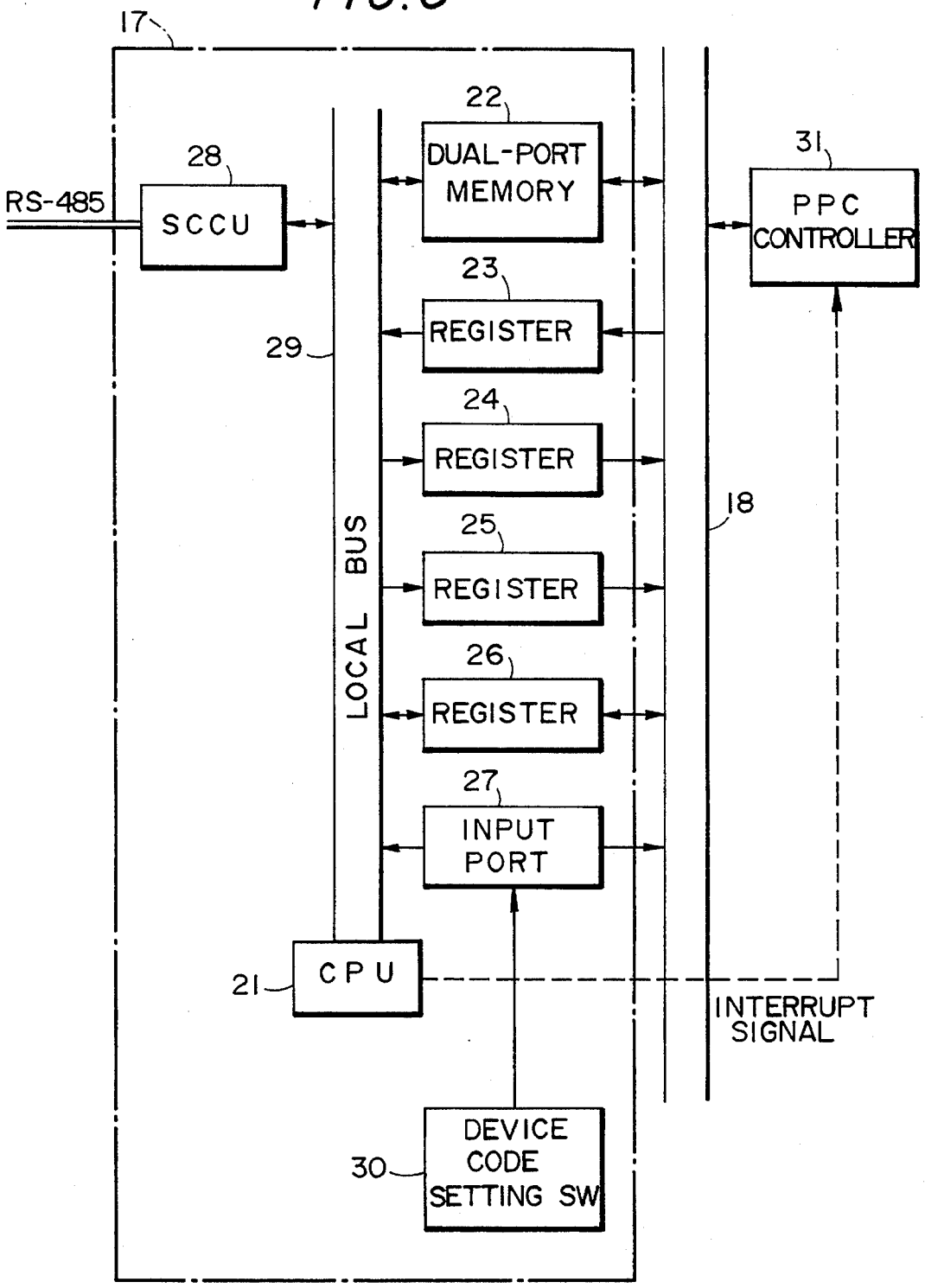
FIG. 5 is a schematic block diagram showing a personal interface included in control system.

A specific construction of the personal I/F 17 is shown in FIG. 5. As shown, the I/F 17 has one-chip microcomputer made up of a CPU 21, a dual-port memory 22, registers 23–26, an input port 27, a SCCU 28, a local bus 29, ROM, not shown, and RAM, not shown, and a device code setting switch 30. The CPU 21 controls the entire I/F 17. The dual-port memory 22 is accessible from both of the CPUs 11 and 21 and allows the I/F 17 and a PPC controller 31 to interchange text data. The PPC controller 31 is constituted by the CPU 11, ROM 12, RAM 13, NVRAM 14, I/O port 15, and SCCU 16. The registers 23–26 are used to control the interchange of the text data, although they will not be described specifically. The device code setting switch 30 is used to set a device code particular to the copier 1. The switch 30 identifies a device code in the event of polling and selection from the data communication device 3. The SCCU 28 is connectable to the device 3 and/or the personal I/F 17 of another copier 1.

Figure 6:
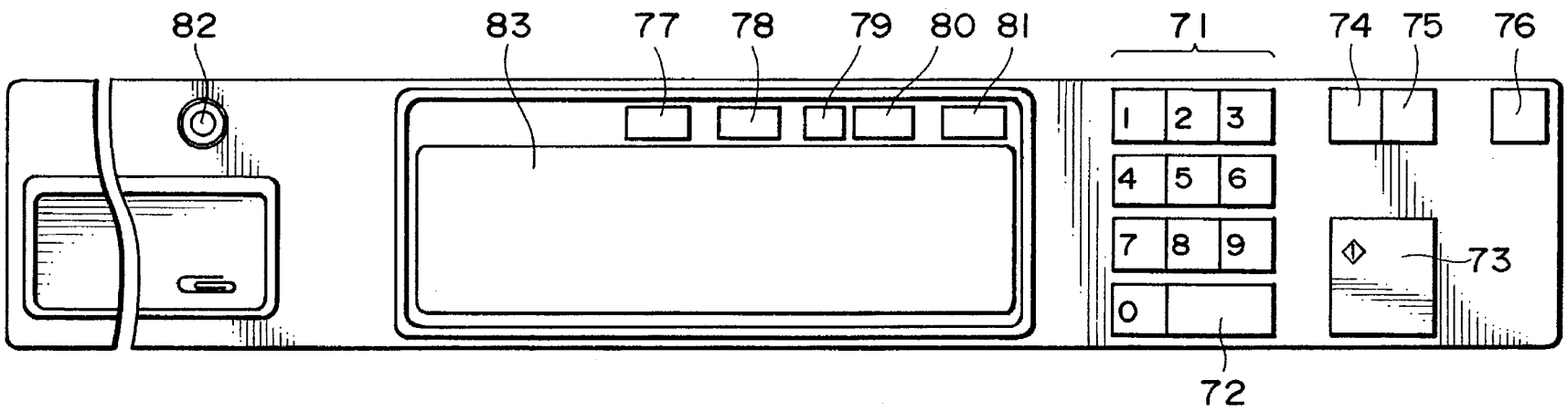
FIG. 6 is a plan view showing a specific arrangement of an operation panel mounted on the copier of FIG. 1.

FIG. 6 shows a specific arrangement of an operation panel mounted on the copier 1. As shown, the operation panel includes numeral keys 71, a clear/stop key 72, a copy start key 73, an enter key 74, an interrupt key 75, a preheat heat 76, a mode confirmation key 77, a screen switch key 78, a call key 79, a register key 80, a guidance key 81, a contrast volume 82 for display, and a character display 83.

Figure 7:
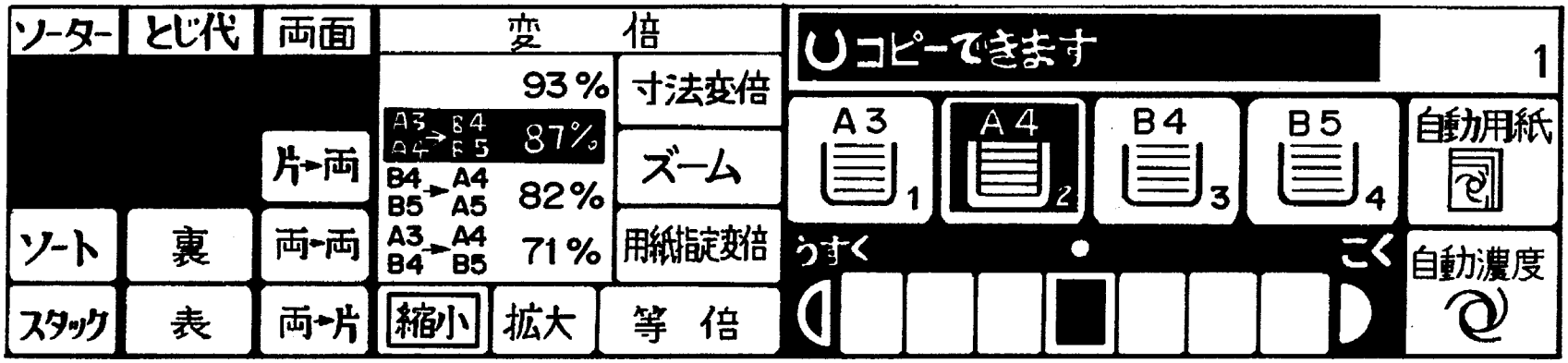
FIG. 7 shows a specific copy mode setting picture to appear on a character display included in the operation board.

The numeral keys 71 are accessible for inputting a desired number of copies, desired magnification, and other numerical values. The clear/stop key 72 is used to clear the number of copies input or to stop a copying operation. The copy start key 73 is used to start a copying operation. The enter key 74 is used to fix various numerical values entered, e.g., a zoom magnification and a binding margin. The interrupt key 75 allows a person to interrupt a copying operation under way in order to copy another document. The preheat key 76 is used to cancel all the input information or to set up a preheat mode for a power saving purpose. The mode confirmation key 77 is accessible for confirming modes which will appear on the character display 83 as a list. The screen switch key 78 allows a person to change the display mode of the character display 83 in matching relation to the person's skill. The call key 78 is used to call a user program. The register key 80 is used to register a user program. The guidance key 81 may be pressed to see a guidance on the character display 83. The contrast volume 82 may be operated to adjust the contrast of the character display 83. The character display is made up of a liquid crystal display (LCD), fluorescent display tube, or similar full-dot display device, and a substantially transparent sheet-like matrix touch panel laid on the display device. The touch panel accommodates a number of touch sensors each covering, e.g., an 8×8 display pixels. When the copier 1 is switched on, a copy mode setting picture shown in FIG. 7 specifically appears on the character display 83.

When the operator desires to select, e.g., an ADF (Automatic Document Feeder) mode, a duplex copy mode for copying document images on both sides of a paper, or a sort mode for sorting copies, the operator touches a corresponding portion included in the copy mode setting picture. Then, the touched portion is highlighted.

In addition to a simplex copy mode for reproducing a document image on one side of a paper and the above-mentioned duplex copy mode, the copier 1 is operable in a simplex document/duplex copy mode for reproducing images carried on the front of two documents on both sides of a single paper, a duplex document/simplex copy mode for reproducing images carried on both sides of a document on both sides of a single paper, and a duplex document/simplex copy mode for reproducing images carried on both sides of a document on one side of two papers, as selected on the copy mode setting picture.

Figure 8:
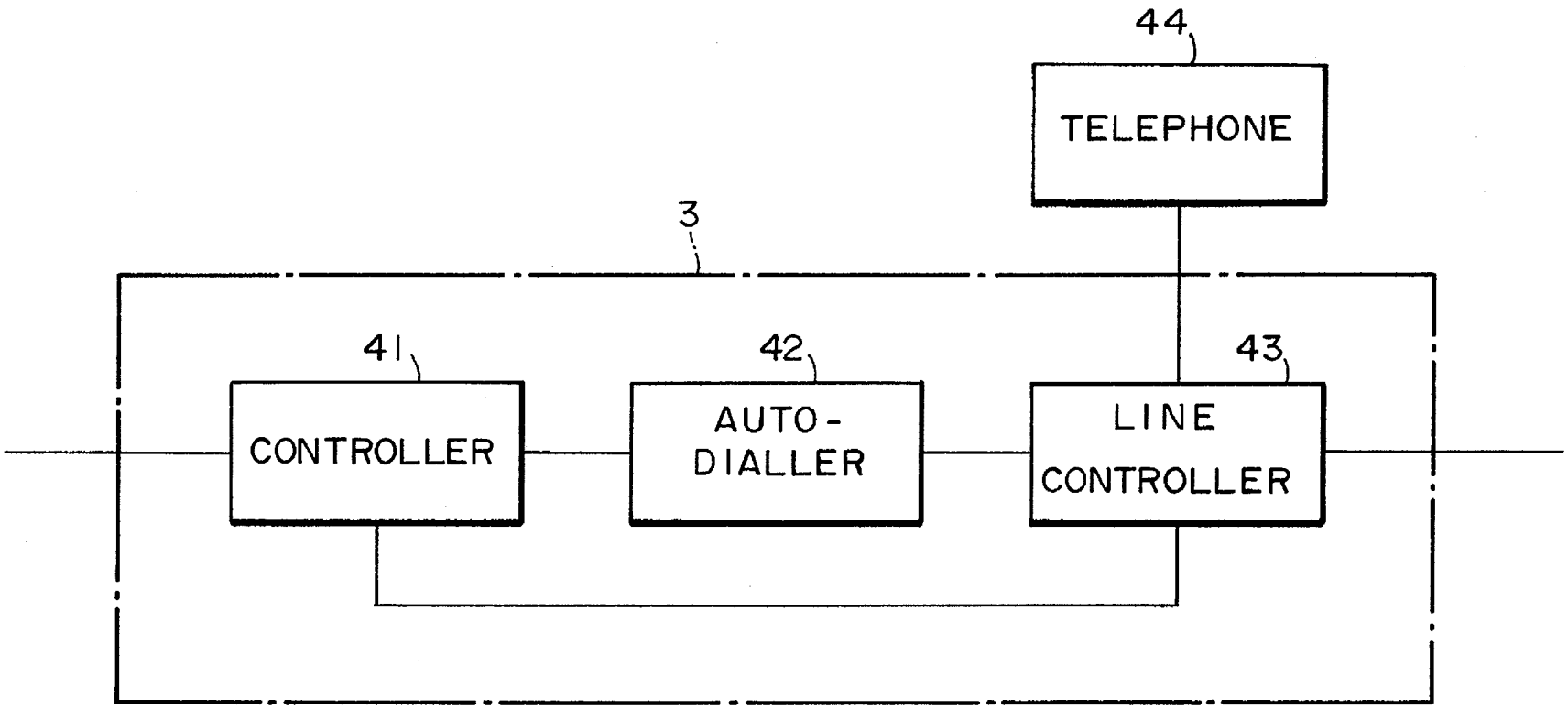
FIG. 8 is a schematic block diagram showing a specific configuration of a data communication device included in the system of FIG. 1.

FIG. 8 shows a specific construction of the data communication device 3. As shown, the device 3 is made up of a controller 41, an auto-dialler 42, and a line controller 43. The controller 4 controls the five copiers 1 and controls the interchange of texts from the control station 2 via the communication line 4. The auto-dialler 42 automatically originates a call in response to a request from any one of the copiers 1. The line controller 43 controls the connection with the communication line 4 and the selection of a telephone set 44. The controller 41, like a conventional controller (e.g. controller shown in FIG. 4), has a ROM storing a control program, a CPU for executing various kinds of control in accordance with the program, a nonvolatile memory, a serial communication control unit, and an I/O port. The nonvolatile memory stores data to be transferred from one of the control station 2 and copiers 1 to the other. In addition, this memory is used to store the device codes assigned to the copiers 1, the telephone number of the control station 2, the number of times that a call is repeatedly originated when line connection fails, the intervals between such repeated calls, the date and time when the content of the total counter 117 is sent, etc.

Ordinary control available with the illustrative embodiment is generally classified into the following three kinds of control:

(1) control from the control station 2 and using texts (2) control from the copier 1 and using texts (3) control particular to the data communication device 3

The above control (1) includes setting and reading control voltages, currents, resistances, timings and other adjustable values of particular one of the copiers 1, reading the number of copies, the number of times of misfeed and other values, and initialization. This control is executed on the receipt of a text from the control station 2 and by the selection from the data communication device 3. The word "selection" refers to selecting one of the copiers 1. Specifically, the device 3 sends to the serial communication interface RS-485 a particular code representative of predetermined selection and the device code assigned to the copier 1 to be selected. The copier 1 compares the device code with its own device code on the basis of the particular code and sees, if they are coincident, that it is selected.

The control (2) is executed when a critical trouble occurs (serviceman call (SC); automatic call origination), when something which needs a preventive measure (alarm) occurs, e.g., when replaceable parts approach their preselected numbers of time of operation or durations or when sensors reach their rated levels (call automatically originated at a preselected time of the day when it has occurred), or when the operator of the copier 1 manipulates the operation panel in a predetermined manner (presses a manual switch) to call the control station 2 (manual call; the station 2 answers the manual call via the telephone set 44). The control (2) is executed by the polling from the data communication device 3. The word "polling" refers to sequentially designating the copiers 1 in order to see if any one of them has generated a connection request. The device 3 sends to the interface RS-485 a particular code representative of predetermined polling and a device code assigned to the copier 1 to be designated. The copier 1 compares the device code with its own device code on the basis of the particular code and sees, if they compare equal, that it is designated. In response to an answer from the copier 1, whether the procedure should proceed to the selecting step or whether it should poll the next copier 1 is determined.

As to the control (3), the data communication device 3 reads the contents of the total counters by performing selecting once a day at a predetermined time. The device 3 has two total counter memories A and B and writes total counter values read by selecting once a day in the memory. Hence, the memory A is updated every day except for, e.g., dayoffs. The total counter values stored in the memory A are copied in the memory B once a month on a predetermined day and time (registered at the nonvolatile memory of the unit 3 by the control station 2). When the station 2 accesses the device 3 for reading the total counter values, the device 3 sends the total counters stored in the memory B to the station 2 over the communication line. It is to be noted that the station 3 has a plurality of pairs of memories A and B in order to cope with total counter values relating to, e.g., black-and-white copies, application copies, and color copies.

Figure 9:
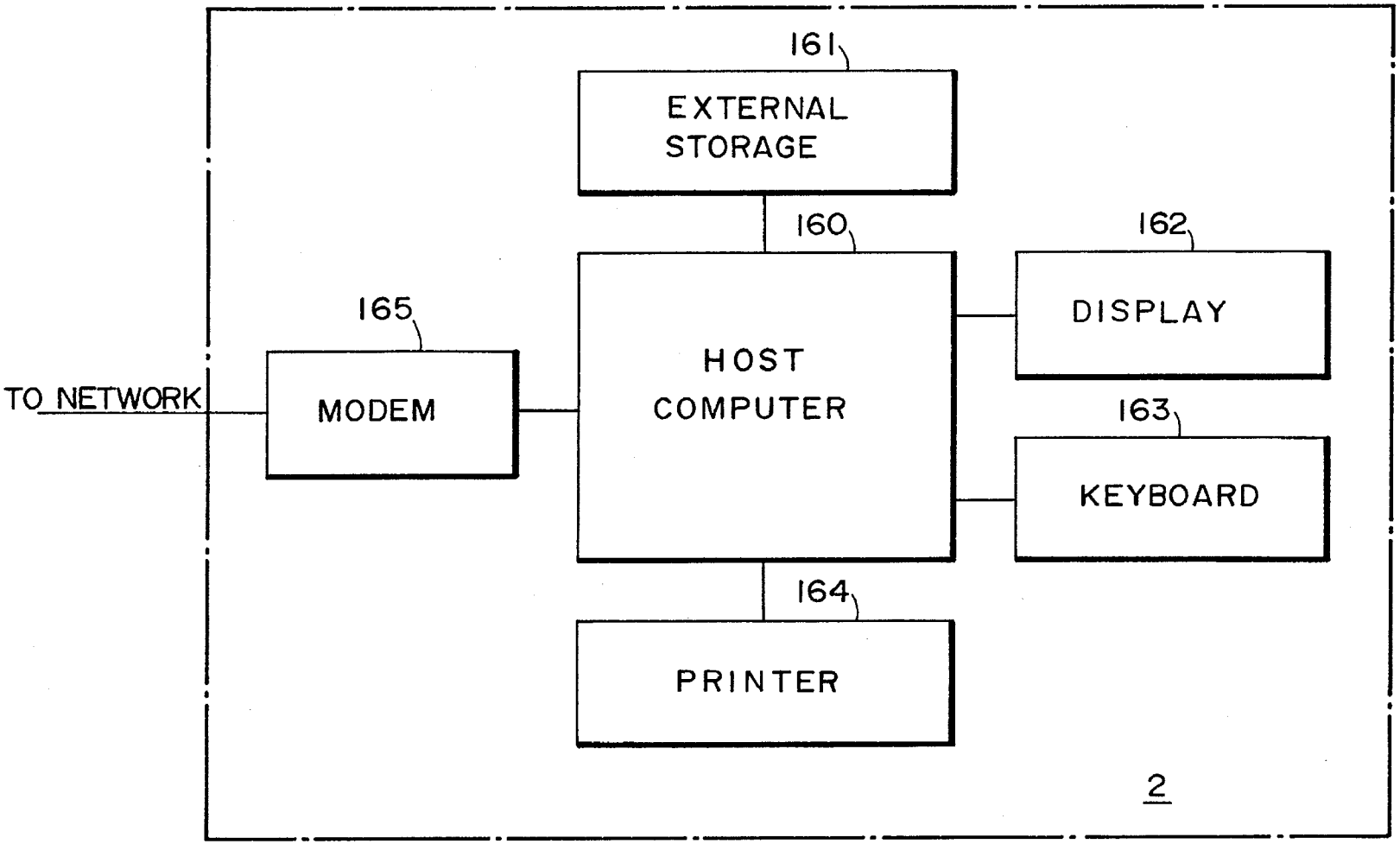
FIG. 9 is a schematic block diagram showing a specific configuration of a control device also included in the system of FIG. 1.

FIG. 9 shows a specific construction of the control station 2. As shown, the station 2 has a host computer 160 for executing various kinds of processing, a magnetic disk or similar external storage 161 for storing administrative data and other data, a display 162, a keyboard 163 for inputting information, a printer 164 for printing out the administrative data, and a modem 165 for connecting the station 2 to the communication line 4.

Figure 10:
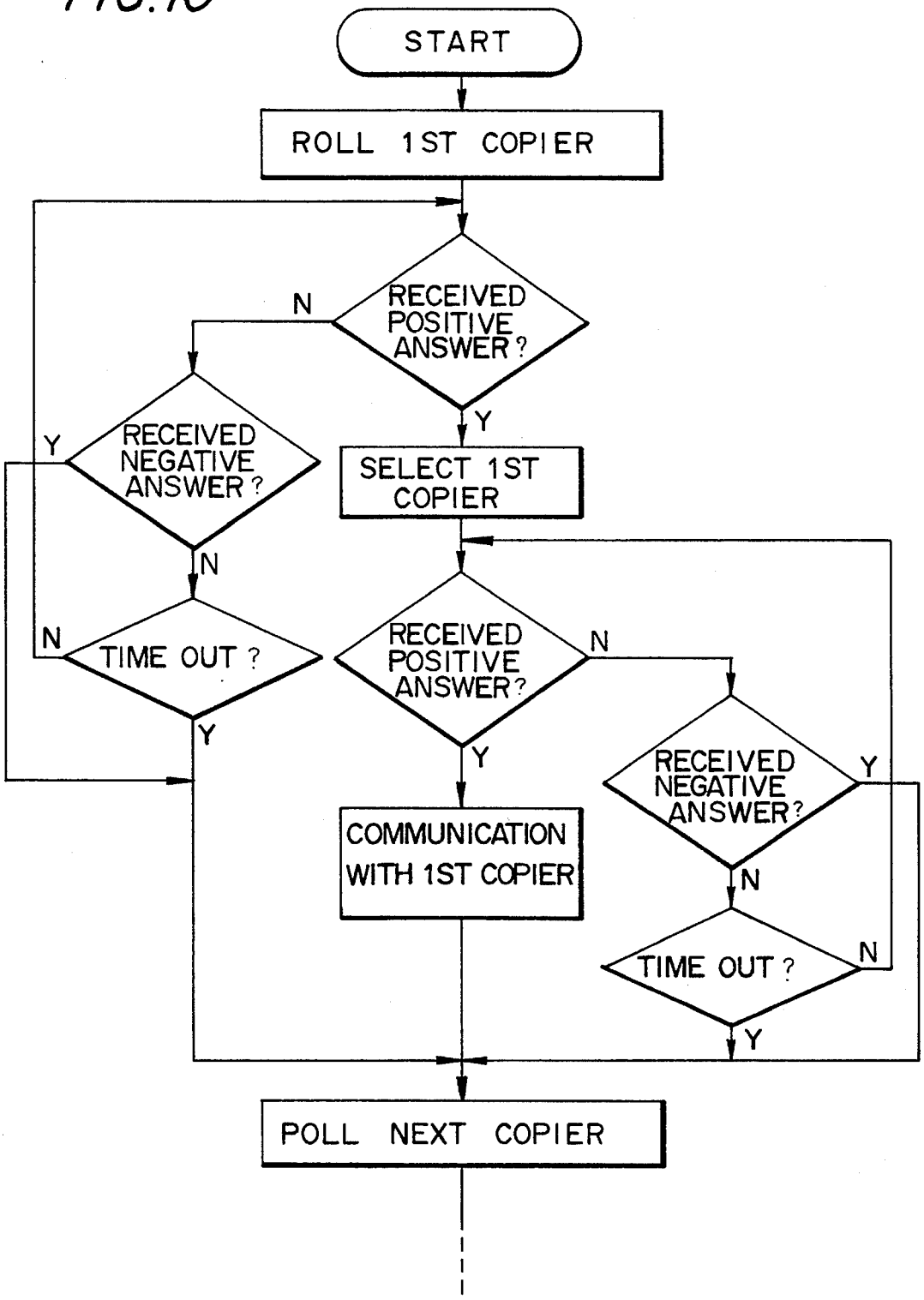
FIG. 10 is a flow chart demonstrating a part of control to be executed by a controller shown in FIG. 8.

Referring to FIG. 10, a part of the control to be executed by the controller 41 of the data communication device 3 will be described. So long as the control station 2 does not access the device 3, the device 3 constantly polls the copiers 1 one by one for the previously mentioned purpose. When the copier 1 (personal I/F 17) polled by the device 3 receives its own device code, it answers the device 3. If the copier 1 is not to send a transmission request, it outputs a negative answer in the form of a predetermined particular code or a combination of particular codes. If the copier 1 is to send a transmission request, it outputs a positive answer in the form of another predetermined code or a combination of such codes.

On receiving the negation from the polled copier 1, the device 3 polls the next copier 1 and repeats the above procedure. On receiving the acknowledgement, the device 3 interrupts the polling and starts selecting the copier 1. Then, the copier 1 sent the acknowledgement again sends a positive answer if it can deal with the selection or sends a negative answer if it cannot do so. In response to the acknowledgement, the device 3 sends to the copier 1 a permission signal implemented as a predetermined particular code or a combination of such codes, and then starts communicating with the copier 1. On completing the communication with the copier 1, the device 3 again starts polling the other copiers 1.

If the copier 1 designated by the device 3 during polling has been switched off or has not been connected, the device 3 does not receive either the acknowledgement or the negation from the copier 1. Then, on the elapse of a predetermined period of time (time out), the device 3 polls the next copier 1 and repeats the above procedure. The device 3 automatically calls the control station 2 either immediately or at a predetermined time of the day, as stated earlier. Hence, items corresponding to such various cases are determined beforehand. In the event of an automatic call, the controller 41 drives the auto-dialler 42 and the line controller 43 which controls the connection of the device 3 with the communication line 4, and then sends data to the control station 2. When the device 3 is accessed by the control station 2 via the communication line 4, it interrupts the polling operation, sends a permission code implemented as a particular code or a combination of such codes to the copier 1, and then starts communicating with the copier 1. On completing the communication with the copier 1, the device 3 again starts polling the other copiers 1.

Figure 11:
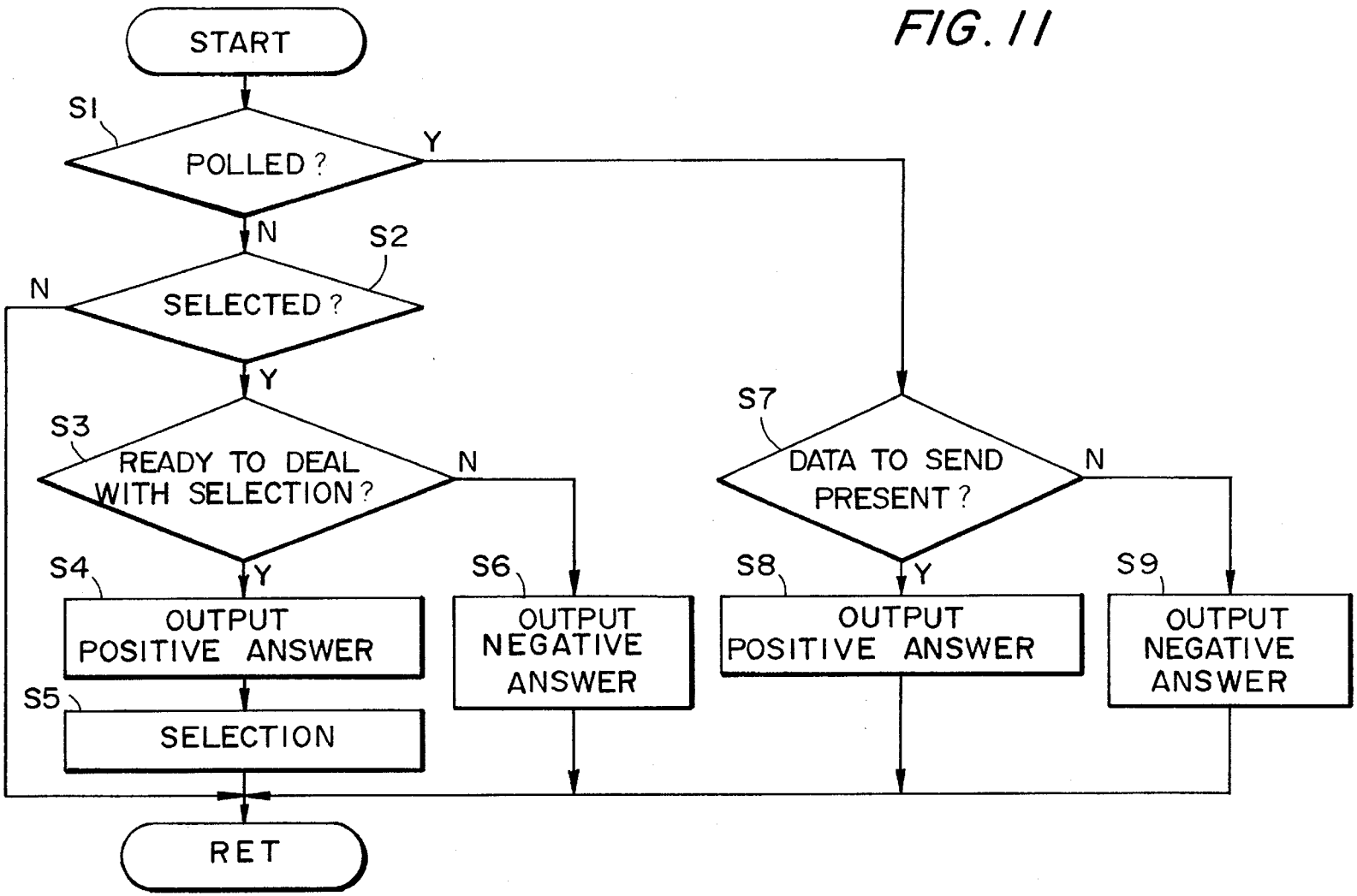
FIG. 11 is a flowchart representative of a polling and selecting procedure to occur between the copier and the data communication device and to be executed by the personal interface of FIG. 4.

FIG. 11 demonstrates a polling and selecting procedure which is a part of the control to be executed by the personal I/F 17 of the copier 1. This procedure occurs periodically after the copier 1 has been switched on. As shown, when the copier 1 is polled by the data communication device 3 (Yes, step S1), it determines whether or not data to be sent is present (step S7). If the answer of the step S7 is positive (Yes), the copier 1 returns a positive answer to the device 3 (step S8), ends the processing, and then waits for selection from the device 3. If the answer of the step S7 is negative (No), the copier 1 returns a negative answer to the device 3 (step S9), and then ends the processing. When the copier 1 is selected by the device 3 (Yes, step S2), it determines whether or not it can deal with the selection (step S3). If the answer of the step S3 is positive, the copier 1 sends a positive answer, executes selection (step S5), and then ends the processing. If the answer of the step S3 is negative because, e.g., the copier 1 is in operation, the copier 1 sends a negative answer (step S6) and then ends the processing.

Figure 12:
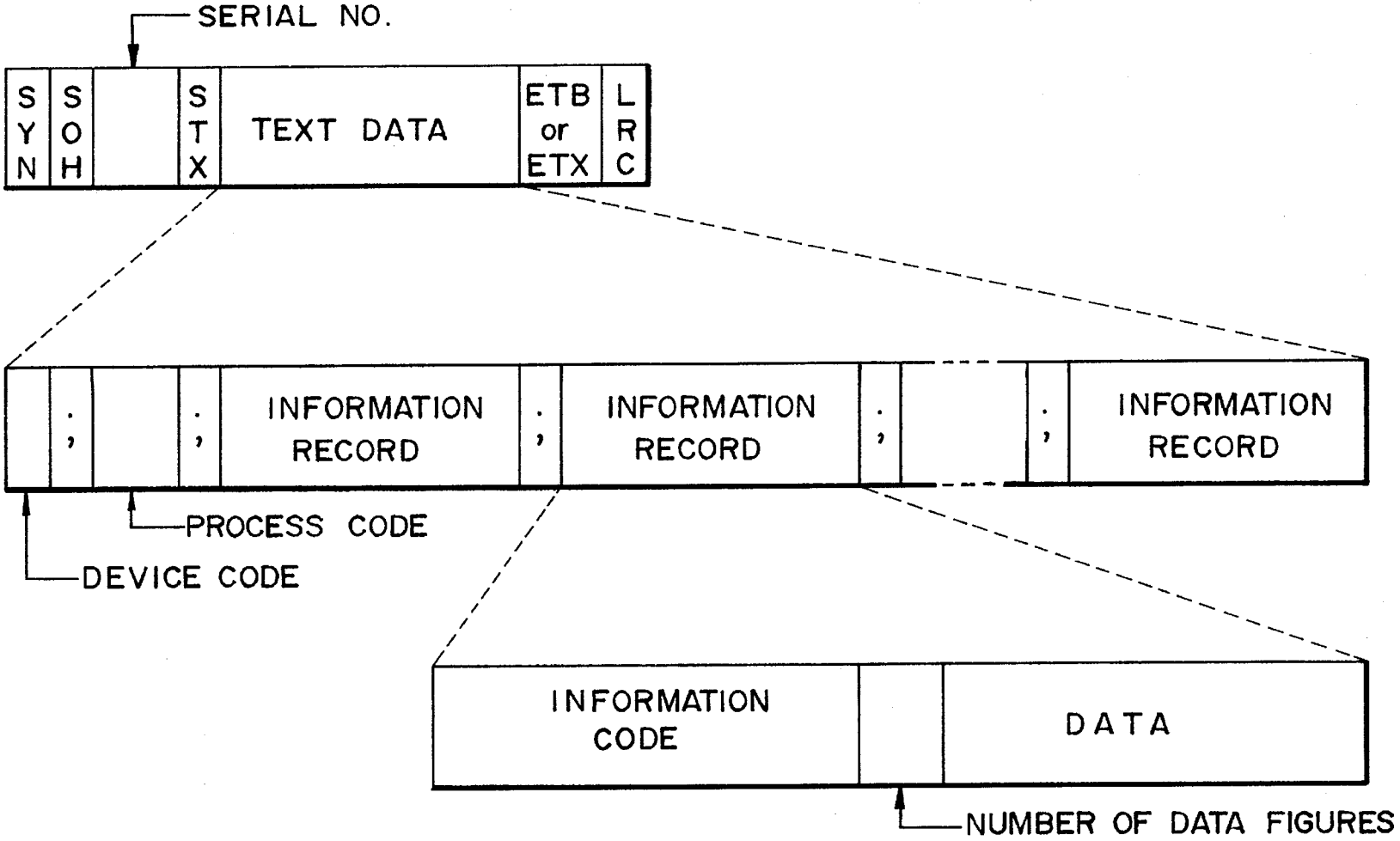
FIG. 12 shows a specific text format to be interchanged between the data communication device and the personal interface.

FIG. 12 shows a specific text format to be interchanged between the data communication device 3 and the personal I/F 17 of the copier 1. As shown, the text includes a serial number representative of a communication block number in a single polling or selection sequence; it is "01" for the first block and sequentially increases by 1 up to "99". The block number "99" is followed by "00". A device code also included in the text is compared with a value set on the switch 30, FIG. 5, copier by copier. The device code, therefore, shows each copier 1 whether or not the current polling or section is meant for it.

In the text, a process code is representative of the purpose of communication. Process codes listed in Table 1 below are preselected.

TABLE 1

| Code | Process Name | Content |
|---|---|---|
| 30 | SC call | auto-report at the time of SC |
| 31 | manual call | auto-report on operation of manual switch |
| 32 | alarm transmission | auto-report at the time of alarm |
| 22 | block billing | auto-report when block billing number is reached |
| 02 | data reading | reading data out of PPC |
| 04 | data writing | updating data in PPC |
| 03 | execution | remote-testing and others |
| 08 | device code confirmation | checking communication functions |

An information record has an information code, the number of figures constituting a data field, and the data field which are predetermined as listed in Table 2 below.

TABLE 2

| Code | Data Length | Content |
|---|---|---|
| Inf. Code | 11 | code representative of specific inf. |
| Number of Data Field Figures | 2 | data length of data field to follow; ASCII code; "00" if data field is absent |
| Data Field | Variable Length | data of contents of inf. codes; absent if the number of figures of data field is "00" |

A separator in the form of a semicolon is positioned between the device code and the process code, between the process code and the information record, and between the information record and the following information record.

Figure 13:
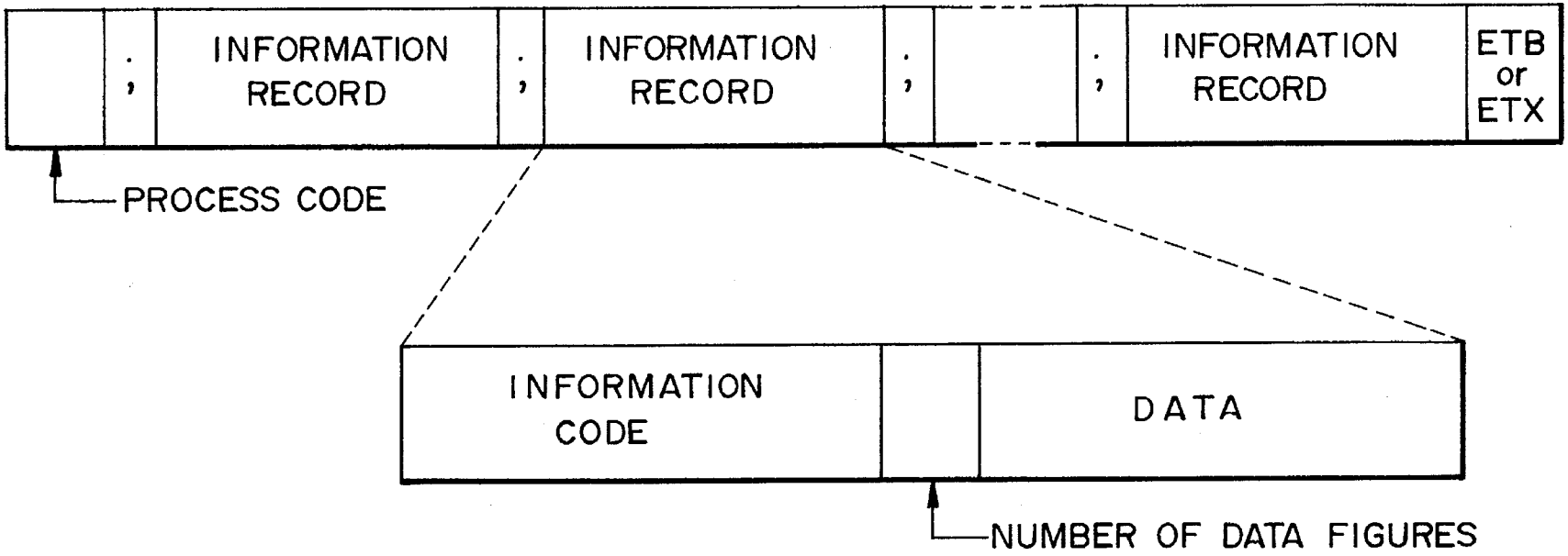
FIG. 13 shows a specific text format to be interchanged between the personal interface and a PPC controller.

FIG. 13 shows a specific text format to be interchanged between the personal I/F 17 of the copier 1 and the PPC controller 31 (see FIG. 5). As shown, this format is similar to the format of FIG. 12 except that it lacks the header, device code, and parity portion.

Figure 14:
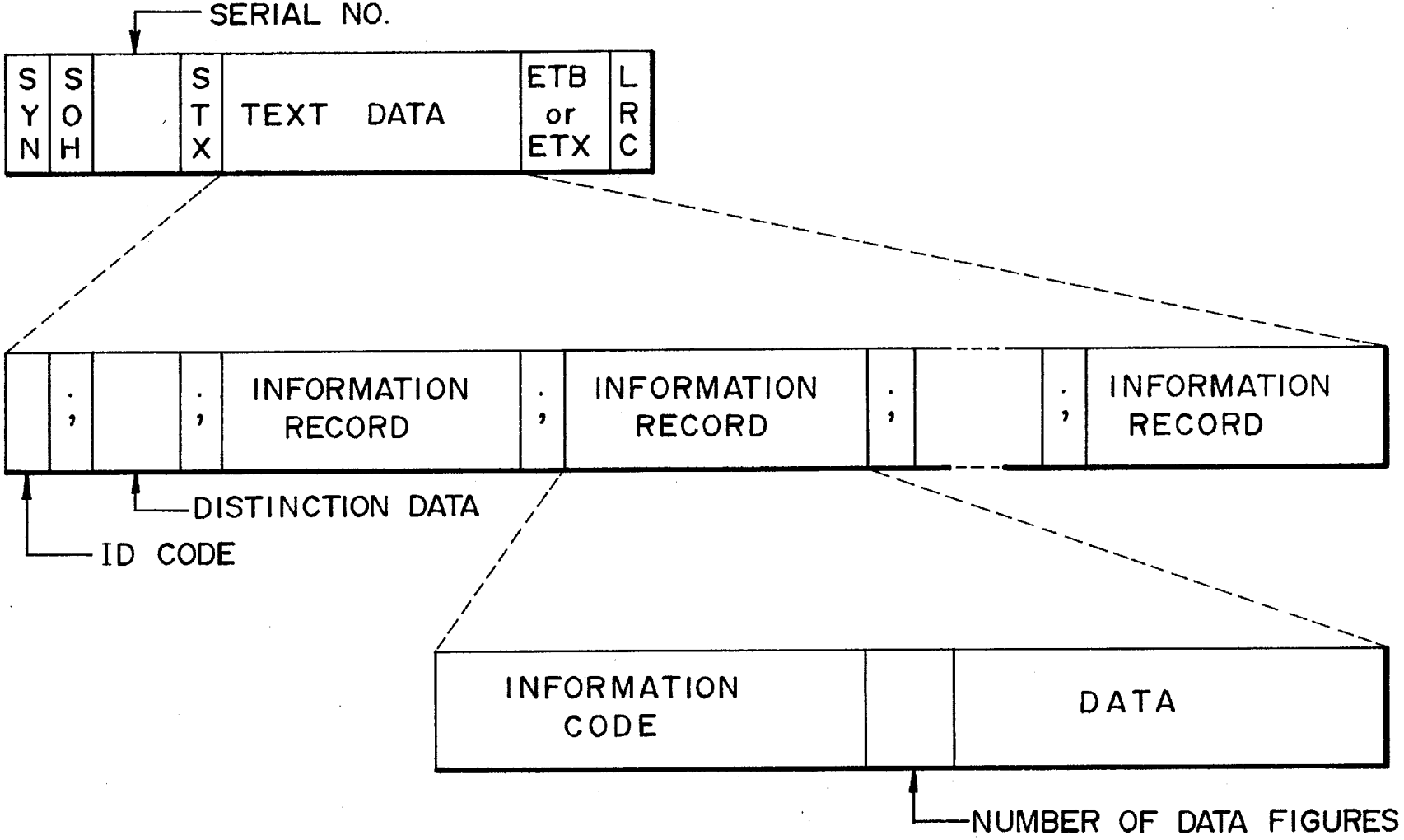
FIG. 14 shows a specific format to be interchanged between the control device and the data communication device.

FIG. 14 shows a specific text format to be interchanged between the control station 2 and the data communication device 3. As shown, the text includes an ID (identification) code. The conversion of the ID code and the device code of FIG. 12 is stored in the nonvolatile memory of the device 3. The ID code and device code are suitably converted on the basis of the direction of the text. A distinction code is similar to the process code of FIG. 12 except that it additionally has the station sending the text and the station to receive it. This is also suitably added or omitted by the device 3.

Referring to FIG, 15, a part of the copier 1 and a part of the control station 2 which directly relate to the present invention are shown specifically. As shown, the NVRAM 14, FIG. 4, included in the copier 1 serves as four counters and four time information memories respectively associated with the counters. The counters are respectively assigned to the temperature sensor 114, humidity sensor 115, image density sensor 113, and electrometer 111. The counters respectively count the occurrences that the outputs of the sensors 113, 114 and and 115 and electrometer 114-111 exceed the respective second limit values which will be described. The time information memories each stores the dates (or similar time information) on which the associated counter counted the above occurrences. Assume that the outputs (voltages) V of the sensors 114, 115 and 113 and electrometer 111 vary with the elapse of time t, as respectively shown in FIGS. 16A–16D. In each of FIGS. 16A–16D, Va is a first upper limit value representative of an upper limit as to the operation of the copier 1 (abnormal as determined by self-diagnosis); Vd is a first lower limit value representative of a lower limit as to the operation of the copier 1; Vb is a second upper limit value which the output of the sensor or the electrometer reaches before reaching the first upper limit value Va; and Vc is a second lower limit value which the output of the sensor or the electrometer reaches before reaching the first lower limit value Vd.

Every time the output of any one of the sensors 113–115 or electrometer 111 exceeds the second limit value (upper or lower) assigned thereto, the CPU 11, FIG. 4, causes the corresponding counter to up-count (+1) while writing the date of counting in the corresponding time information memory. At this instant, the CPU 11 clears the date written to the memory last time. Subsequently, at an alarm report time (predetermined time of the date on which the up-count occurred) or at similar preselected timing, the CPU 11 reads the count out of the counter and the date stored in the time information memory, and sends them via the personal I/F 17 as alarm information. Thereafter, the CPU 11 clears the counter and associated time information memory.

The second upper and lower limit values assigned to the output of each of the above sensors can be freely selected and input on the keys arranged on the operation panel, FIG. 6.

Figure 15:
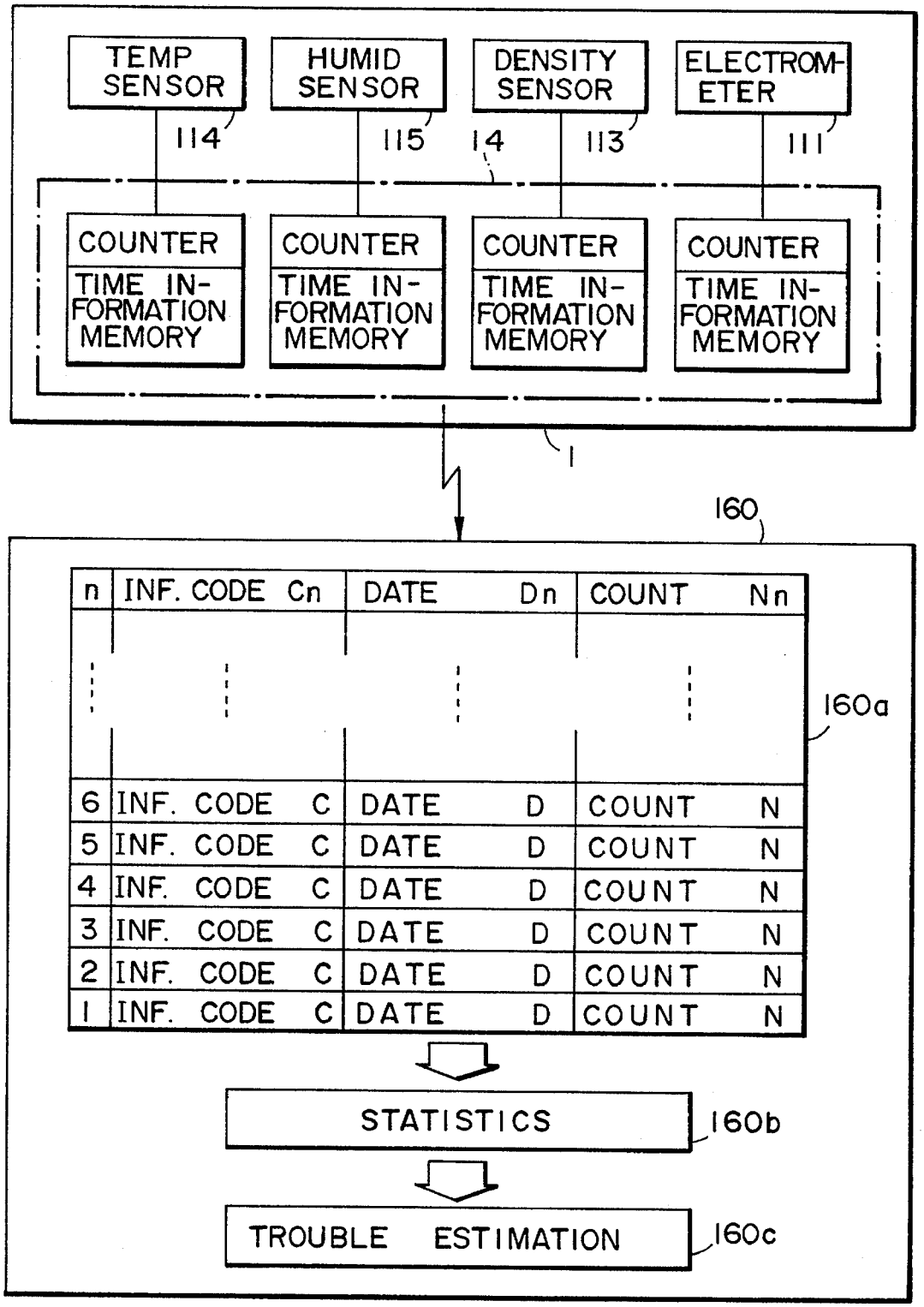
FIG. 15 is a block diagram schematically showing a part of the copier and control device which directly relates to the present invention.
Figure 16A:
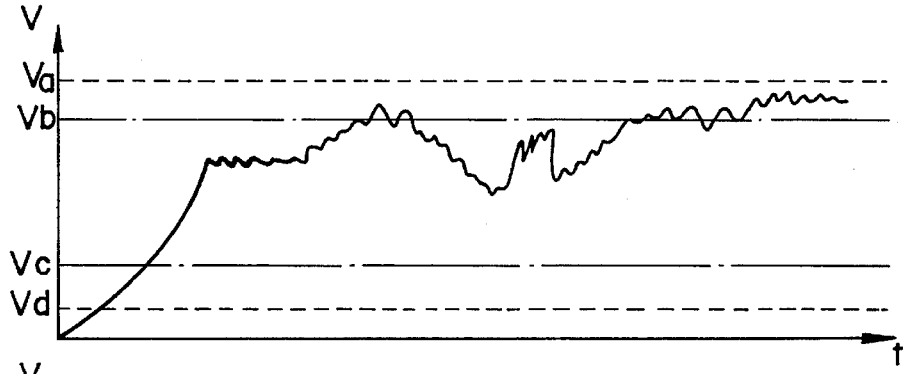
FIGS. 16A–16D show curves respectively showing specific relations between the outputs of sensors and time.
Figure 16B:
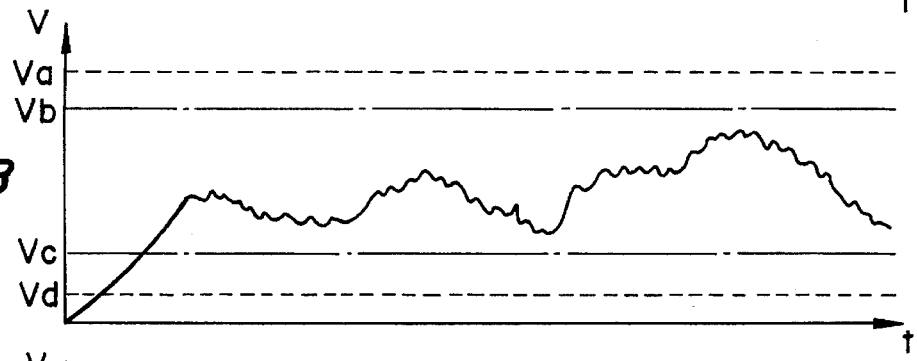
Figure 16C:
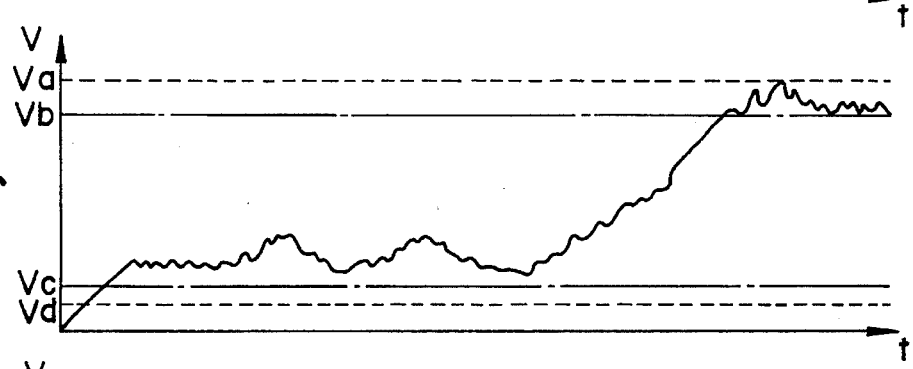
Figure 16D:
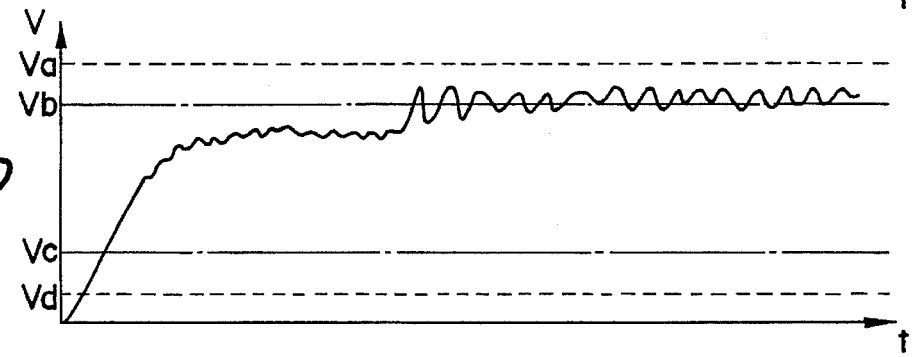

The alarm information are sent from each copier 1 to the host computer 160 of the control station 2, FIG. 9, via the data communication device 3 and communication line 4. The host computer 160 writes the alarm information in a data storage (RAM or similar memory) **160*a*, FIG. 15. Then, a statistics 160*b*, FIG. 15, performs statistical processing on the basis of the alarm information. A trouble estimation 160*c*, FIG. 15, estimates troubles to occur in the individual copiers 1 on the basis of the results of the statistical processing. It is to be noted that the data storage 160*a*, statistics 160*b* and trouble estimation 160*c*** are implemented as a microcomputer.

Figure 17:
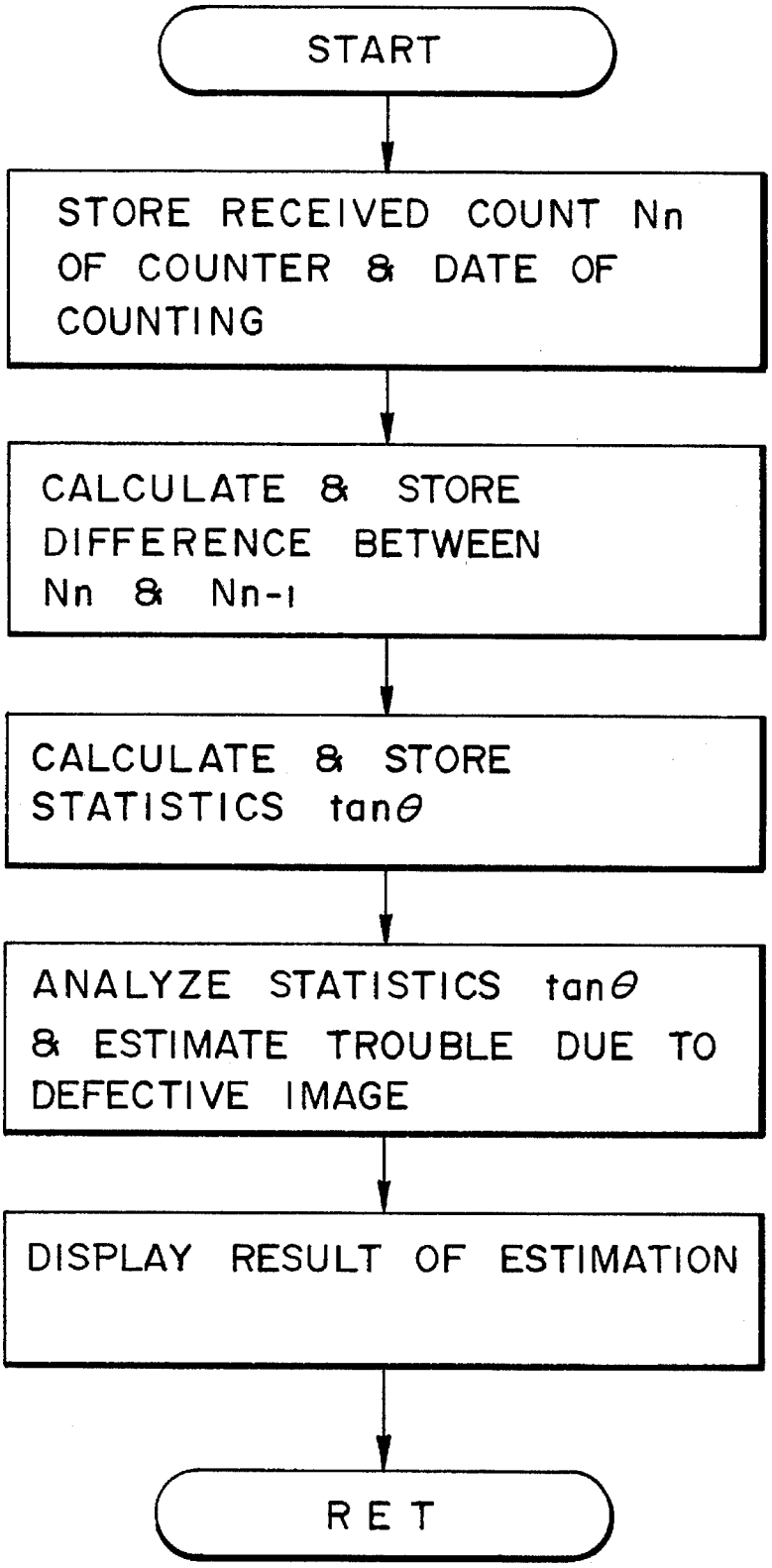
FIG. 17 is a flowchart representative of a statistics and trouble estimating procedure to be executed by a host computer shown in FIG. 9.

FIG. 17 demonstrates a statistics and trouble estimation routine to be executed by the host computer 160 specifically. This routine is called and started by a main routine when the count Nn of any one of the counters and the date Dn of the associated time information memory are received from any one of the copiers 1. First, the computer 160 writes the count Nn and date Dn in the data storage **160*a*, produces differences between the count Nn of the date Dn and the count (Nn−1) of the previous date (Dn−1), stores the difference, calculates statistics (tendency value) tanθ based the difference Nn−(Nn−1), stores the value tanθ, analyzes the value tanθ to thereby estimate a trouble to occur in the copier 1 due to defective images, and then displays the result of estimation on the displays 162, FIG. 9**.

Figure 18:
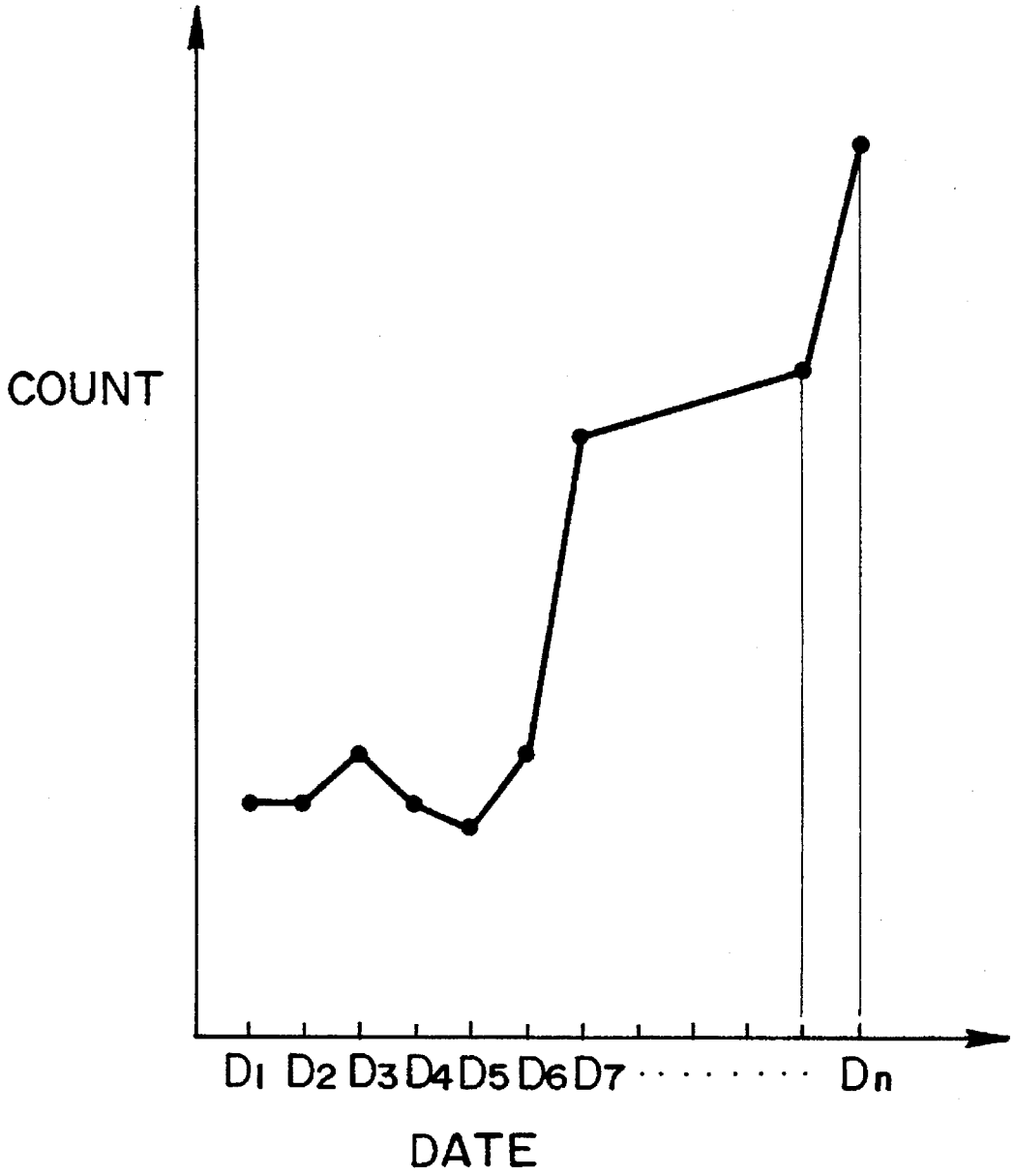
FIG. 18 is a graph indicative of a specific relation between the count of a given counter received from any one of the copiers of FIG. 1 every day and the date of counting.

Assuming that the statistics tanθ is B/A, A and B are respectively representative of one day (Dn−(Dn−1)) and a value produced by dividing the count N of each counter by a predetermined value, e.g., 10. FIG. 18 shows a specific relation between the count N of a given counter and the date D of counting which are received from a given copier 1 every day. As shown, the count N shows a sharp increase from the date Dn−1 to the date Dn, indicating that a trouble probably occurs in the near future. Hence, when the statistics tanθ increases above, e.g., "1.5", the trouble estimation 160*c* may determine that a trouble attributable to defective images is likely to occur in the copier 1 in the near future.

In the illustrative embodiment, each copier 1 determines how many times the output of each sensor shown FIG. 2 and joining in the image control exceeds its second limit value, and stores the date on which it is counted. Alternatively, the copier 1 may store the date and time or any other suitable time information, or the cumulative number of copies counted by the total counter 117. Then, the counts of the counters and the other time information or the cumulative numbers of copies will be sent to the control station 2 as alarm information.

Figure 19:
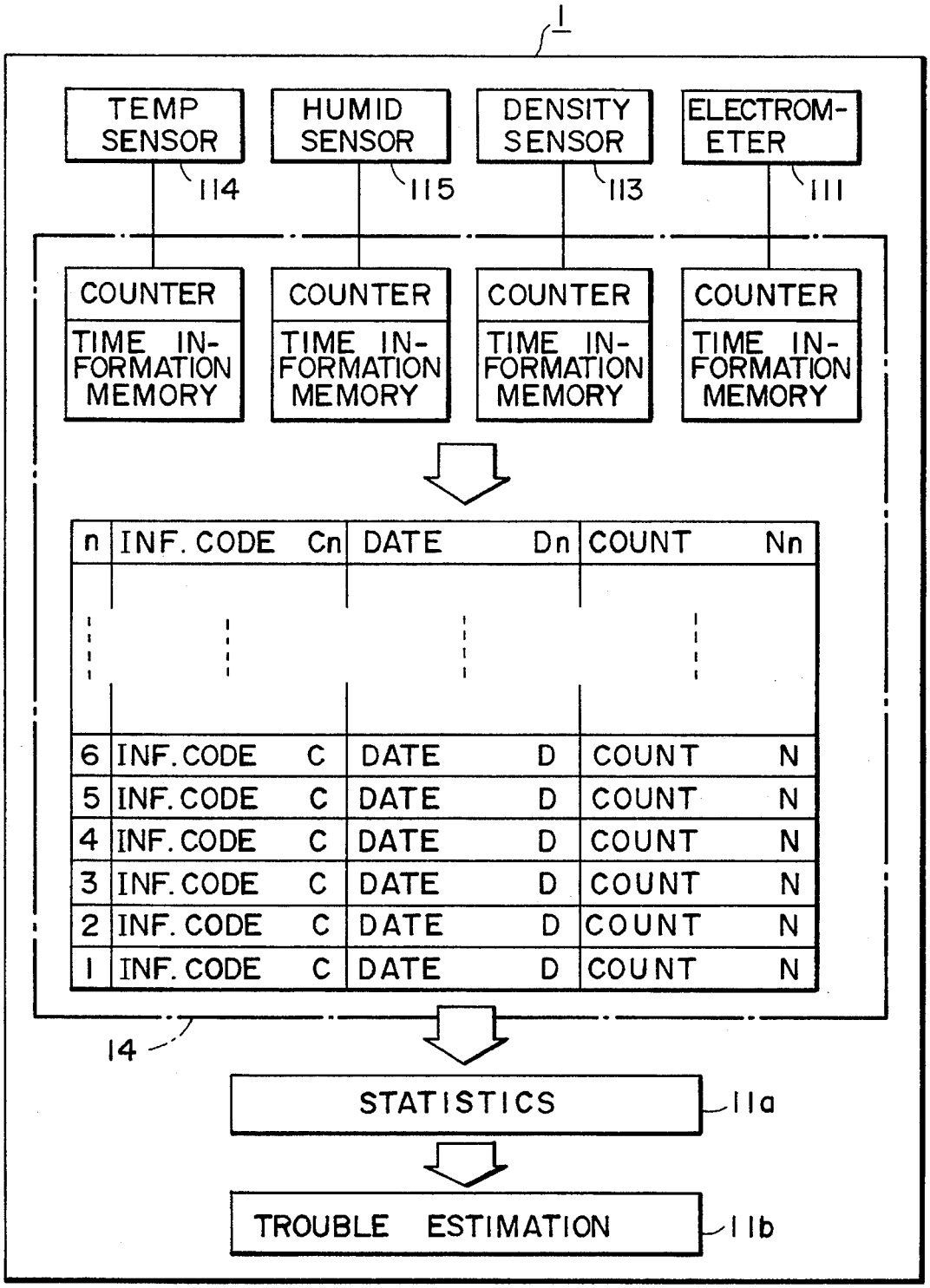
FIG. 19 is a block diagram schematically showing a part of a copier included in an alternative embodiment of the present invention and directly relating to the invention.

Referring to FIG. 19, an alternative embodiment of the present invention will be described. The following description will concentrate on the difference between the previous embodiment and the alternative embodiment. FIG. 19 shows a specific configuration of a part of the copier 1 which directly relates to the present invention. As shown, the NVRAM 14, FIG. 4, plays the role of a data storage in addition to the previously stated role of the counters and the role of time information memories. Specifically, the NVRAM 14 writes in the data storage thereof the counts of the counters and the dates read out of the time information memories. In this case, every time the output of any one of the sensors exceeds its second limit value, the CPU 11 causes the corresponding counter to up-count (+1). Subsequently, when the copier 1 is idle, the CPU 11 writes the date of counting of the counter in the corresponding time information memory. At this instant, the CPU 11 clears the date existing in the time information memory.

Thereafter, the CPU 11 reads the count of the counter and the date stored in the associated time information memory at the alarm report time or similar predetermined timing, writes them in the data storage, causes a statistics 11*a* to perform statistical processing on the basis of the count and date, and then causes a trouble estimation 11*b* to estimate a trouble to occur in the copier 1. Subsequently, the CPU 11 clears the counter and time information memory. It is to be noted that the CPU 11 serves as the statistics 11*a* and trouble estimation 11*b*.

Again, the second upper and lower limit values assigned to the output of each of the above sensors can be freely selected and input on the keys arranged on the operation panel, FIG. 6.

Figure 20:
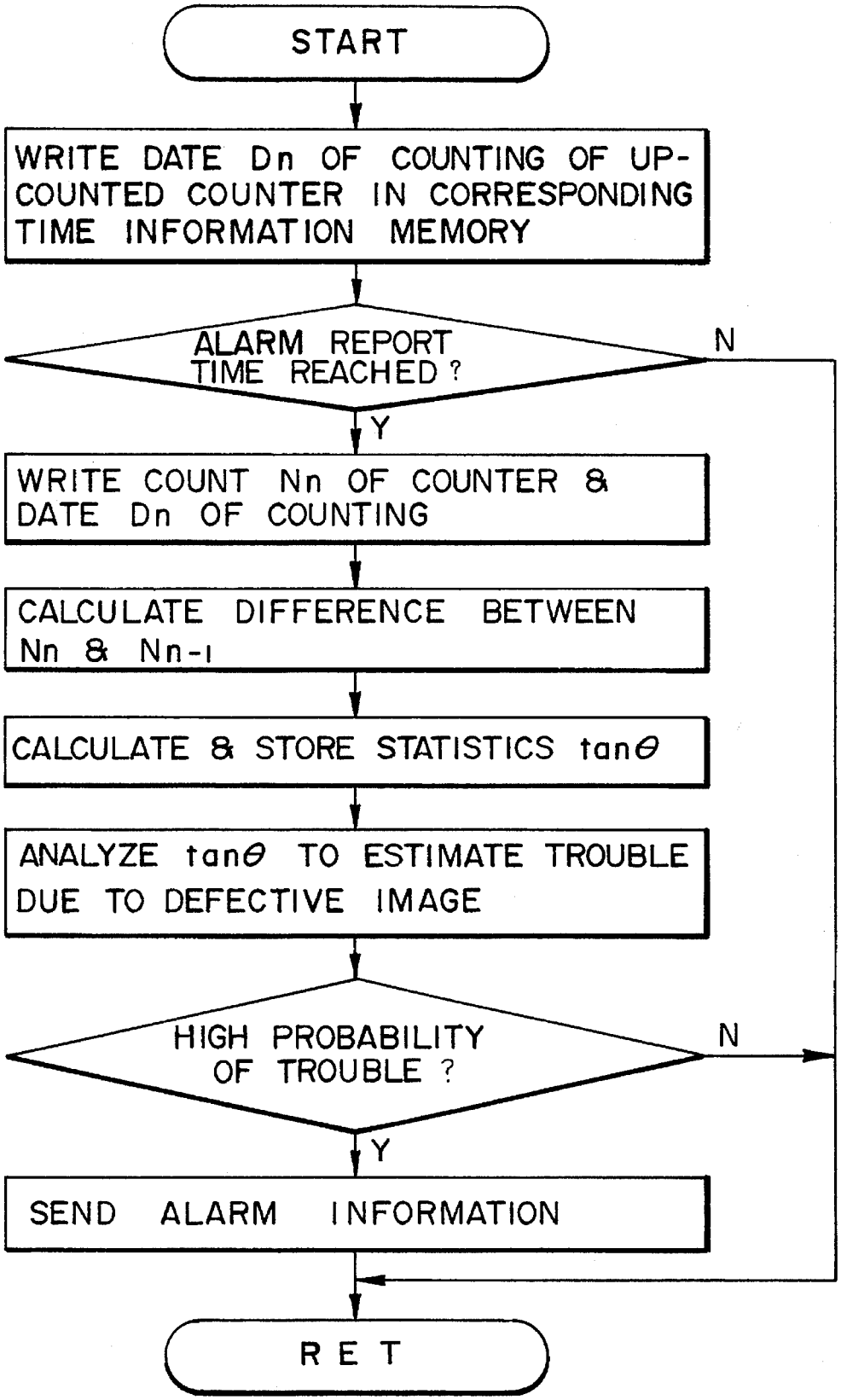
FIG. 20 is a flowchart representative of a statistics and trouble estimating procedure to be executed by the copier of FIG. 19.

FIG. 20 shows a statistics and trouble estimation routine to be executed by the CPU 11 of the copier. This routine is called and started when the output of any one of the sensors 114, 115 and 113 and electrometer 111 exceeds its second limit value and counted by the corresponding counter. First, the CPU 11 writes the date Dn of counting in the corresponding time information memory. Then, the CPU 11 determines whether or not an alarm should be reported (designated time). If the answer of this decision is positive, the CPU 11 reads the count Nn of the counter and the date Dn stored in the associated time information memory, produces a difference between the count Nn of the date Dn and the count (Nn−1) of the previous date (Dn−1), and then stores the difference.

Subsequently, the CPU 11 calculates the statistics (tendency value) tanθ from the difference Nn−(Nn−1), stores the statistics tanθ, analyzes the statistics tanθ in order to estimate a trouble to occur in the copier 1 due to defective images (as in the previous embodiment), determines whether or not a trouble is likely to occur in the copier 1 in the near future on the basis of the result of estimation, and if the answer of this decision is positive, reports it via the personal I/F 17 as alarm information. If desired, the alarm information may be displayed on the character display 83 of the operation panel, FIG. 10. The host computer 160 of the control station 2 displays on the display 162 the alarm information received from the copier 1 via the data communication device 3 and communication line 4.

In this embodiment, each copier 1 also determines how many times the output of each sensor shown FIG. 2 and joining in the image control exceeds its second limit value, and stores the date when it is counted. Alternatively, the copier 1 may store the date and time or any other suitable time information, or the cumulative number of copies counted by the total counter 117. Then, the copier 1 will perform statistical processing with the count of the counter and the other time information or the cumulative number of copies on the basis of the alarm information.

In any of the embodiments shown and described, the counters may each count occurrences that the output of a particular sensor shown in FIG. 3 and joining in self-diagnosis exceeds its second limit value. Then, the date of counting or similar time information or the cumulative number of copies will be stored.

Furthermore, in the embodiments, the control station 2 collectively controls a plurality of copiers 1. On receiving the alarm information from any one of the copiers 1, the control unit 2 is capable of performing remote-processing for the copier 1 on the basis of the contents of the information or capable of sending to a host computer situated at another service station support information requesting it to send a serviceman. This information, of course, includes the telephone number of the copier 1.

Hence, when the probability that a trouble due to defective images occurs in the copier 1 in the near future high, the control station 2 may send to a host computer situated at another service station the estimated trouble information as support information. Further, the information may be sent to corresponding one of terminals connected to the host computer and displayed on the display of the terminal.

The illustrative embodiment has concentrated on a system in which a plurality of copiers are connected to a control station by a data communication device and a communication line. However, the present invention is similarly applicable to a system in which image forming apparatuses other than copiers, e.g., printers are connected to a control station by, for example, a data communication device and a communication line, or even to an image forming apparatus itself.

Some basic constructions of the image forming apparatus in accordance with the present invention will be described hereinafter.

Figure 21:
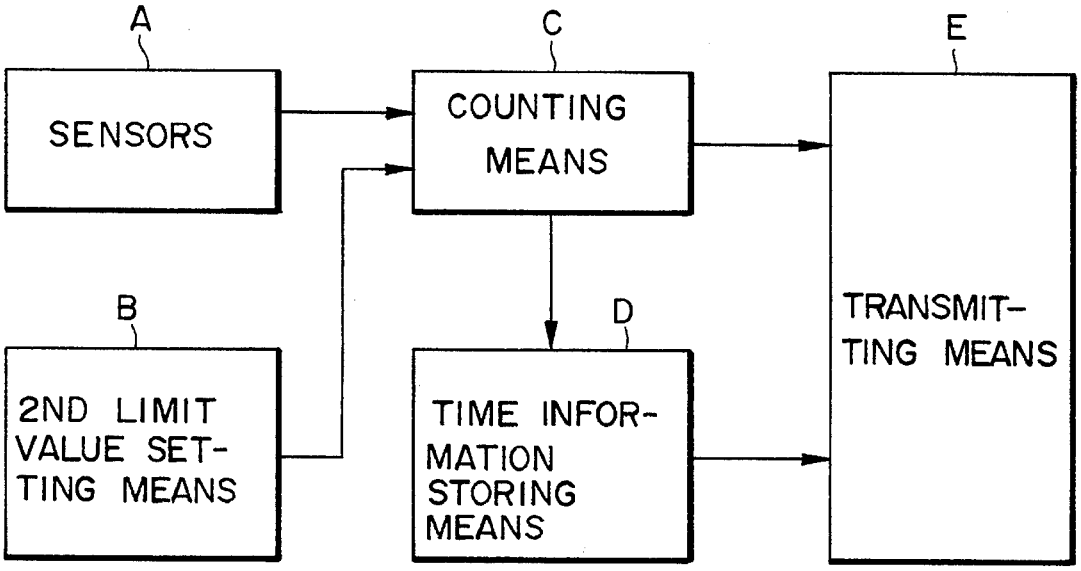
FIGS. 21–24 are schematic block diagrams each showing a particular basic construction of the image forming apparatus of the present invention.

As shown in FIG. 21, a first basic construction has various sensors A disposed in the apparatus. Second limit value setting means B sets for the output of each sensor a second limit value which the sensor output reaches before reaching a first limit value representative of the operation limit of the apparatus. Counting means C counts the occurrences that the output of any one of the sensors A exceeds the second limit value. Time information storing means D stores the date on which the means C counted the occurrences or similar time information. Transmitting means E sends the counts of the counting means C and the time information stored in the storing means D.

Figure 22:
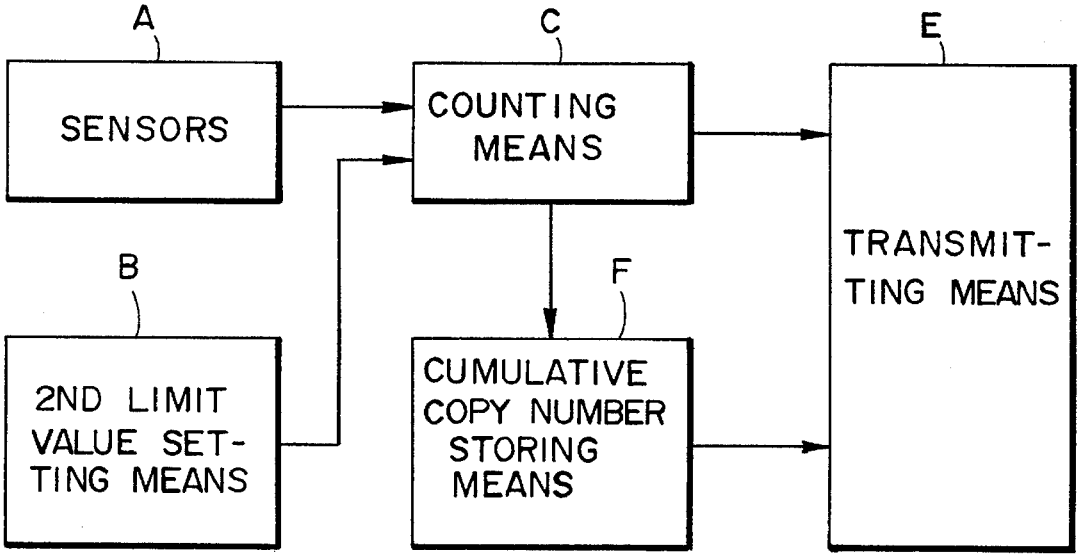

As shown in FIG. 22, a second basic construction is similar to the construction of FIG. 21 except that cumulative copy number storing means F is substituted for the time information storing means. The storing means F stores the cumulative number of copies at the time when the counting means C counted the above occurrences. In this case, the transmitting means F sends the cumulative number of copies stored in the storing means F together with the count of the counting means C.

Figure 23:
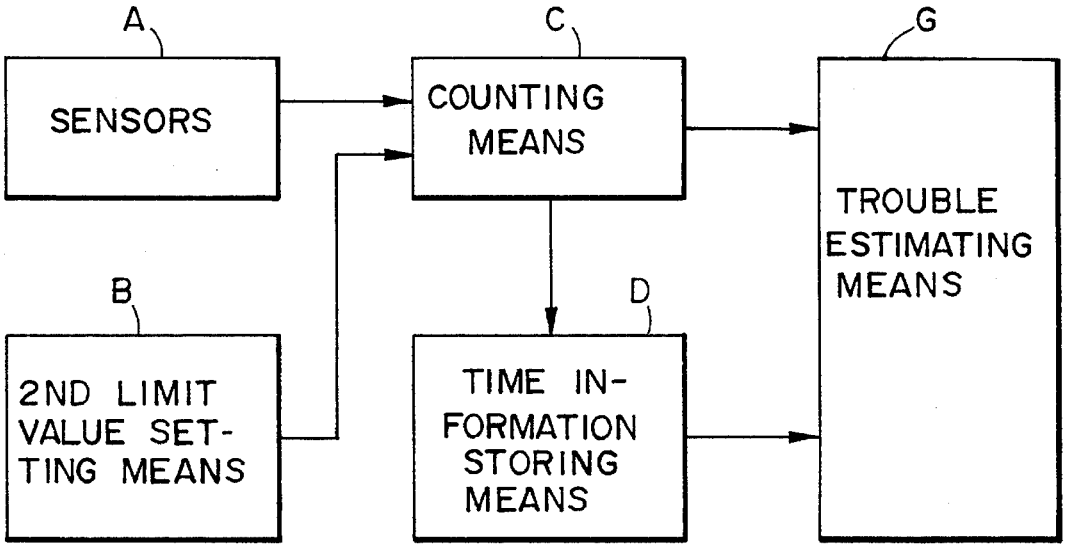
Figure 24:
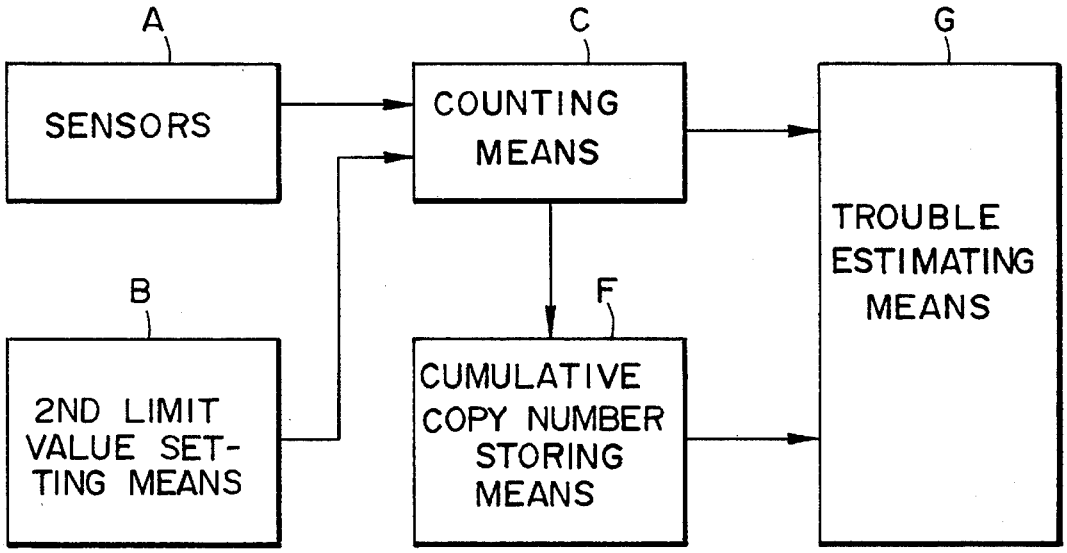

As shown in FIG. 23, a third basic construction is also similar to the construction of FIG. 21 except that trouble estimating means G is substituted for the transmitting means E. The trouble estimating means G estimates a trouble to occur in the apparatus on the basis of the count of the counting means C and the cumulative number of copies at the time when the counting means C counted the occurrences.

In any of the above basic constructions, the second limit value setting means B may be arranged to allow any desired second limit value to be set, if desired. In addition, a plurality of second limit values may be used.

On the other hand, in a first basic construction of the administration system, a plurality of image forming apparatuses each having any one of the constructions of FIGS. 21–24 are connected to a control station by a communication line and collectively controlled by the control station. In each apparatus, the transmitting means E sends the counts of the counting means C and the time information stored in the time information storing means D to the control station. The controls station has the trouble estimating means G for estimating troubles to occur in the individual apparatuses on the basis of the counts and time information received from the apparatuses.

A second basic construction of administration system is similar to the first basic construction except for the following. The transmitting means sends the counts of the counting means C and the cumulative numbers of copies stored in the storing means F to the control station. The control station has the trouble estimating means for estimating troubles to occur in the individual apparatuses on the basis of the counts of the counting means C and the cumulative numbers of copies.

In summary, it will be seen that the present invention provides an image forming apparatus having various unprecedented advantages, as enumerated below.

(1) The apparatus counts the occurrences that the outputs of sensors each exceeds a particular second limit value before reaching a first limit value representative of the operation limit of the apparatus, stores the date of counting or similar time information or the cumulative number of copies at the time of counting, and sends the count and the time information or the cumulative number of copies. It is, therefore, possible to estimate troubles to occur in the individual apparatuses by causing an exclusive trouble estimating device to receive and analyze the above information.

(2) Because the apparatus should only count the increase in the output of each sensor above the second limit value and store the time information at the time of counting or the cumulative number of copies, it is simple in construction and does not need a memory having a great capacity and, therefore, reduces the cost.

(3) If the apparatus estimates a trouble to occur therein on the basis of the count and the date or similar time information or the cumulative number of copies, the exclusive trouble estimating device is not necessary. This kind of configuration also achieves the above advantage (2).

(4) Because any desired second limit value can be set in matching relation to the characteristic of the machine and how it is used, troubles to occur in the apparatus can be estimated with accuracy.

(5) Because a plurality of second limit values can be set for each sensor output, delicate control is achievable over the estimation of troubles.

Further, the present invention provides a system for administering a plurality of image forming apparatuses at a control station. Each apparatus sends the previously stated counts and the time information or the cumulative numbers of copies to the control station. In response, the control station estimates troubles to occur in the individual apparatus on the basis of the counts and the time information or the cumulative numbers of copies. This also successfully achieves the advantage (3).

Various modifications will become possible for those skilled in the art after receiving the teachings of the present disclosure without departing from the scope thereof.

What is claimed is:

1. An image forming apparatus comprising:

second limit value setting means for setting second limit values which outputs of sensors disposed in said apparatus respectively reach before reaching respective first limit values each being representative of an operation limit of said apparatus;

counting means for counting occurrences that any one of the outputs of the sensors exceeds the respective second limit value;

time information storing means for storing a date or similar time information representative of a time when said counting means counted said occurrences; and transmitting means for transmitting a count of said counting means and said time information stored in said time information storing means.

2. An apparatus as claimed in claim 1, wherein said second limit values are freely selectable.

3. An apparatus as claimed in claim 1, wherein said second limit value setting means is capable of setting a plurality of limit values for each of the outputs of the sensors.

4. An image forming apparatus comprising:

second limit value setting means for setting second limit values which outputs of sensors disposed in said apparatus respectively reach before reaching respective first limit values each being representative of an operation limit of said apparatus;

counting means for counting occurrences that any one of the outputs of the sensors exceeds the respective second limit value;

cumulative copy number storing means for storing a cumulative number of copies at the time when said counting means counted said occurrences; and transmitting means for transmitting a count of said counting means and said cumulative number of copies stored in said cumulative copy number storing means.

5. An apparatus as claimed in claim 4, wherein said second limit values are freely selectable.

6. An apparatus as claimed in claim 4, wherein said second limit value setting means is capable of setting a plurality of limit values for each of the outputs of the sensors.

7. An image forming apparatus comprising:

second limit value setting means for setting second limit values which outputs of sensors disposed in said apparatus respectively reach before reaching respective first limit values each being representative of an operation limit of said apparatus;

counting means for counting occurrences that any one of the outputs of the sensors exceeds the respective second limit value;

a second limit value setter for setting second limit values which outputs of sensors disposed in said apparatus respectively reach before reaching respective first limit values each being representative of an operation limit of said apparatus;

a plurality of counters for respectively counting occurrences that the outputs of the sensors exceed the respective second limit values;

a plurality of time information memories respectively associated with said plurality of counters, and for respectively storing dates or similar time information representative of times when said plurality of counters counted said occurrences; and a trouble estimator for estimating a trouble to occur in said apparatus on the basis of counts of said plurality of counters and said time information stored in said plurality of time information memories.

22. An apparatus as claimed in claim 21, wherein said second limit values are freely selectable.

23. An apparatus as claimed in claim 21, wherein said second limit value setter is capable of setting a plurality of limit values for each of the outputs of the sensors.

24. An image forming apparatus comprising:

a second limit value setter for setting second limit values which outputs of sensors disposed in said apparatus respectively reach before reaching respective first limit values each being representative of an operation limit of said apparatus;

a plurality of counters for respectively counting occurrences that the outputs of the sensors exceed the respective second limit values;

a plurality of cumulative copy number memories respectively associated with said plurality of cumulative copy number memories, and for respectively storing cumulative numbers of copies at the time when said plurality of counters counted said occurrences; and a trouble estimator for estimating a trouble to occur in said apparatus on the basis of counts of said plurality of counters and said cumulative numbers stored in said plurality of cumulative copy number memories.

25. An apparatus as claimed in claim 24 wherein said second limit values are freely selectable.

26. An apparatus as claimed in claim 24, wherein said second limit value setter is capable of setting a plurality of limit values for each of the outputs of the sensors.

27. A system for administering a plurality of image forming apparatuses, said plurality of image forming apparatuses each comprising a second limit value setter for setting second limit values which outputs of sensors disposed in said apparatus respectively reach before reaching respective first limit values each being representative of an operation limit of said apparatus, a plurality of counters for respectively counting occurrences that said outputs of said sensors exceed the respective second limit values, a plurality of time information memories respectively associated with said plurality of counters, and for respectively storing dates or similar time information representative of times when said plurality of counters counted said occurrences, and a transmitter for transmitting counts of said plurality of counters and said time information stored in said plurality of time information memories, said system comprising:

a control device for collectively controlling said plurality of image forming apparatuses; and a communication line for connecting said plurality of image forming apparatuses to said control device;

wherein said transmitter transmits said counts of said plurality of counters and the time information stored in said plurality of time information memories, and wherein said control device estimates troubles to occur in said image forming apparatuses on the basis of said counts and said time information.

28. A system for administering a plurality of image forming apparatuses, said plurality of image forming apparatuses each comprising a second limit value setter for setting second limit values which outputs of sensors disposed in said apparatus respectively reach before reaching respective first limit values each being representative of an operation limit of said apparatus, a plurality of counters for respectively counting occurrences that said outputs of said sensors exceed the respective second limit values, a plurality of cumulative copy number memories respectively associated with said plurality of counters, and for respectively storing cumulative numbers of copies at the time when said plurality of counters counted said occurrences, and a transmitter for transmitting counts of said plurality of counters and said cumulative numbers of copies stored in said plurality of cumulative copy number memories, said system comprising:

a control device for collectively controlling said plurality of image forming apparatuses; and a communication line for connecting said plurality of image forming apparatuses to said control device;

wherein said transmitter transmits said counts of said plurality of counters and said cumulative numbers of copies stored in said plurality of cumulative copy number memories, and wherein said control device estimates troubles to occur in said image forming apparatuses on the basis of said counts and said cumulative numbers of copies.

29. An image forming method comprising the steps of:

setting second limit values which outputs of sensors disposed in said apparatus respectively reach before reaching respective first limit values each being representative of an operation limit of said apparatus;

counting occurrences that any one of the outputs of said sensors exceeds the respective second limit value;

storing a date or similar time information representative of a time when said occurrences were counted; and transmitting a count of said occurrences and said time information.

30. A method as claimed in claim 29, wherein said second limit values are freely selectable.

31. A method as claimed in claim 29, wherein a plurality of limit values are set for each of the outputs of said sensors.

32. An image forming method comprising the steps of:

setting second limit values which outputs of sensors disposed in said apparatus respectively reach before reaching respective first limit values each being representative of an operation limit of said apparatus;

counting occurrences that any one of the outputs of said sensors exceeds the respective second limit value;

storing a cumulative number of copies at the time when said occurrences were counted; and transmitting a count of said occurrences and said cumulative number of copies.

33. A method as claimed in claim 32, wherein said second limit values are freely selectable.

34. A method as claimed in claim 32, wherein a plurality of limit values are set for each of the outputs of said sensors.

35. An image forming method comprising the steps of:

setting second limit values which outputs of sensors disposed in said apparatus respectively reach before time information storing means for storing a date or similar time information representative of a time when said counting means counted said occurrences; and trouble estimating means for estimating a trouble to occur in said apparatus on the basis of a count of said counting means and said time information stored in said time information storing means.

8. An apparatus as claimed in claim 7, wherein said second limit values are freely selectable.

9. An apparatus as claimed in claim 7, wherein said second limit value setting means is capable of setting a plurality of limit values for each of the outputs of the sensors.

10. An image forming apparatus comprising:

second limit value setting means for setting second limit values which outputs of sensors disposed in said apparatus respectively reach before reaching respective first limit values each being representative of an operation limit of said apparatus;

counting means for counting occurrences that any one of the outputs of the sensors exceeds the respective second limit value;

cumulative copy number storing means for storing a cumulative number of copies at the time when said counting means counted said occurrences; and trouble estimating means for estimating a trouble to occur in said apparatus on the basis of a count of said counting means and said cumulative number of copies stored in said cumulative copy number storing means.

11. An apparatus as claimed in claim 10 wherein said second limit values are freely selectable.

12. An apparatus as claimed in claim 10, wherein said second limit value setting means is capable of setting a plurality of limit values for each of the outputs of the sensors.

13. A system for administering a plurality of image forming apparatuses, said plurality of image forming apparatuses each comprising second limit value setting means for setting second limit values which outputs of sensors disposed in said apparatus respectively reach before reaching respective first limit values each being representative of an operation limit of said apparatus, counting means for counting occurrences that any one of said outputs of said sensors exceeds the respective second limit value, time information storing means for storing a date or similar time information representative of a time when said counting means counted said occurrences, and transmitting means for transmitting a count of said counting means and said time information stored in said time information storing means, said system comprising:

a control device for collectively controlling said plurality of image forming apparatuses; and a communication line for connecting said plurality of image forming apparatuses to said control device;

wherein said transmitting means transmits said count of said counting means and said time information stored in said time information storing means, and wherein said control device estimates a trouble to occur in said image forming apparatuses on the basis of said count and said time information.

14. A system for administering a plurality of image forming apparatuses, said plurality of image forming apparatuses each comprising second limit value setting means for setting second limit values which outputs of sensors disposed in said apparatus respectively reach before reaching respective first limit values each being representative of an operation limit of said apparatus, counting means for counting occurrences that any one of said outputs of said sensors exceeds the respective second limit value, cumulative copy number storing means for storing a cumulative number of copies at the time when said counting means counted said occurrences, and transmitting means for transmitting a count of said counting means and said cumulative number of copies stored in said cumulative copy number storing means, said system comprising:

a control device for collectively controlling said plurality of image forming apparatuses; and a communication line for connecting said plurality of image forming apparatuses to said control device;

wherein said transmitting means transmits said count of said counting means and said cumulative number of copies stored in said cumulative copy number storing means, and wherein said control device estimates a trouble to occur in said image forming apparatuses on the basis of said count and said cumulative number of copies.

15. An image forming apparatus comprising:

a second limit value setting setter for setting second limit values which outputs of sensors disposed in said apparatus respectively reach before reaching respective first limit values each being representative of an operation limit of said apparatus;

a plurality of counters for respectively counting occurrences that the outputs of the sensors exceed the respective second limit values;

a plurality of time information memories respectively associated with said plurality of counters, and for respectively storing dates or similar time information representative of times when said plurality of counters counted said occurrences; and a transmitter for transmitting counts of said plurality of counters and said time information stored in said plurality of time information memories.

16. An apparatus as claimed in claim 15, wherein said second limit values are freely selectable.

17. An apparatus as claimed in claim 15, wherein said second limit value setter is capable of setting a plurality of limit values for each of the outputs of the sensors.

18. An image forming apparatus comprising:

a second limit value setter for setting second limit values which outputs of sensors disposed in said apparatus respectively reach before reaching respective first limit values each being representative of an operation limit of said apparatus;

a plurality of counters for respectively counting occurrences that the outputs of the sensors exceed the respective second limit values;

a plurality of cumulative copy number memories respectively associated with said plurality of counters, and for respectively storing cumulative numbers of copies at the time when said plurality of counters counted said occurrences; and a transmitter for transmitting counts of said plurality of counters and said cumulative numbers of copies stored in said plurality of cumulative copy number memories.

19. An apparatus as claimed in claim 18, wherein said second limit values are freely selectable.

20. An apparatus as claimed in claim 18, wherein said second limit value setter is capable of setting a plurality of limit values for each of the outputs of the sensors.

21. An image forming apparatus comprising:

reaching respective first limit values each being representative of an operation limit of said apparatus;

counting occurrences that any one of the outputs of said sensors exceeds the respective second limit value;

storing a date or similar time information representative of a time when said occurrences were counted; and estimating a trouble to occur in said apparatus on the basis of a count of said occurrences and said time information.

36. A method as claimed in claim 35, wherein said second limit values are freely selectable.

37. A method as claimed in claim 35, wherein a plurality of limit values are set for each of the outputs of said sensors.

38. An image forming method comprising the steps of:

setting second limit values which outputs of sensors disposed in said apparatus respectively reach before reaching respective first limit values each being representative of an operation limit of said apparatus;

counting occurrences that any one of the outputs of said sensors exceeds the respective second limit value;

storing a cumulative number of copies at the time when said occurrences were counted; and estimating a trouble to occur in said apparatus on the basis of a count of said occurrences and said cumulative number of copies.

39. A method as claimed in claim 38 wherein said second limit values are freely selectable.

40. A method as claimed in claim 38, wherein a plurality of limit values are set for each of the outputs of said sensors.

41. A method of collectively administering a plurality of image forming apparatuses connected to a control device by a communication line, said method comprising the steps of:

preparing said plurality of image forming apparatuses each comprising second limit value setting means for setting second limit values which outputs of sensors disposed in said apparatus respectively reach before reaching respective first limit values each being representative of an operation limit of said apparatus, counting means for counting occurrences that any one of said outputs of said sensors exceeds the respective second limit value, time information storing means for storing a date or similar time information representative of a time when said counting means counted said occurrences, and transmitting means for transmitting a count of said counting means and said time information stored in said time information storing means;

causing said transmitting means to send said count of said counting means and said time information stored in said time information storing means; and causing said control device to estimate a trouble to occur in said image forming apparatus on the basis of said count and said time information.

42. A method of collectively administering a plurality of image forming apparatuses connected to a control device by a communication line, said method comprising the steps of:

preparing said plurality of image forming apparatuses each comprising second limit value setting means for setting second limit values which outputs of sensors disposed in said apparatus respectively reach before reaching respective first limit values each being representative of an operation limit of said apparatus, counting means for counting occurrences that any one of said outputs of said sensors exceeds the respective second limit value, cumulative copy number storing means for storing a cumulative number of copies at the time when said counting means counted said occurrences, and transmitting means for transmitting a count of said counting means and said cumulative numbers of copies stored in said cumulative copy number storing means;

causing said transmitting means to send said count of said counting means and said cumulative numbers of copies stored in said cumulative copy number storing means; and causing said control device to estimate a trouble to occur in said image forming apparatus on the basis of said count and said cumulative number of copies.

* * * * *